US006462007B1

(12) United States Patent
Pieroni et al.

(10) Patent No.: US 6,462,007 B1
(45) Date of Patent: Oct. 8, 2002

(54) MULTI-LAYER DETERGENT TABLET

(75) Inventors: Lucio Pieroni, Cincinnati, OH (US); Peter Robert Foley, Cincinnati, OH (US); Lynda Anne Speed, Newcastle upon Tyne (GB); Xiaoqing Song, West Chester, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/601,043

(22) PCT Filed: Nov. 5, 1998

(86) PCT No.: PCT/US98/23615

§ 371 (c)(1),
(2), (4) Date: Jul. 26, 2000

(87) PCT Pub. No.: WO99/37746

PCT Pub. Date: Jul. 29, 1999

Related U.S. Application Data

(60) Provisional application No. 60/072,551, filed on Jan. 26, 1998.

(51) Int. Cl.[7] ..... C11D 17/00; B08B 9/20

(52) U.S. Cl. ..... 510/224; 510/298; 510/446; 134/25.2

(58) Field of Search ..... 510/224, 446, 510/298; 134/25.2

(56) References Cited

U.S. PATENT DOCUMENTS

| | | | | |
|---|---|---|---|---|
| 4,460,490 A | | 7/1984 | Barford et al. | 252/92 |
| 4,828,749 A | | 5/1989 | Kruse et al. | 252/135 |
| 4,913,832 A | | 4/1990 | Kruse et al. | 252/99 |
| 5,133,892 A | | 7/1992 | Chun et al. | 252/90 |
| 5,759,974 A | * | 6/1998 | Menke et al. | 510/191 |
| 5,783,540 A | | 7/1998 | Secemski et al. | 510/224 |
| 5,900,399 A | * | 5/1999 | Seiter et al. | 510/446 |
| 5,972,870 A | * | 10/1999 | Anderson | 510/298 |

FOREIGN PATENT DOCUMENTS

| | | | |
|---|---|---|---|
| DE | 195 31 690 | 3/1997 | C11D/1/83 |
| EP | 0 055 100 | 6/1982 | C11D/17/00 |
| EP | 0 110 731 | 6/1984 | C11D/1/14 |
| EP | 0 224 128 | 6/1987 | C11D/3/08 |
| EP | 0 224 135 | 6/1987 | C11D/17/00 |
| EP | 0 481 547 | 4/1992 | C11D/17/00 |
| EP | 0 481 793 | 4/1992 | C11D/17/00 |
| EP | 0 851 024 | 7/1998 | C11D/17/00 |
| GB | 1 307 387 | 2/1973 | C11D/11/00 |
| JP | 62 225600 | 10/1987 | |
| WO | WO 97/03177 | 1/1997 | C11D/17/00 |
| WO | WO 98/11187 | 3/1998 | C11D/1/825 |

* cited by examiner

*Primary Examiner*—Lorna M. Douyon
(74) *Attorney, Agent, or Firm*—Kevin L. Waugh

(57) ABSTRACT

A multi-layered detergent tablet comprising: a) a core having a first detergent active agent; b) a first encapsulating layer surrounding said core, having a second detergent active agent; c) a second encapsulating layer surrounding said first encapsulating layer, having a third detergent active agent and a disruption system; wherein disruption of said second encapsulating layer is such that at least 25% of said third detergent active agent is released prior to release of said second detergent active agent.

15 Claims, No Drawings

MULTI-LAYER DETERGENT TABLET

This application is a 371 of PCT/US98/23615 filed Nov. 5, 1998 which claims the benefit of U.S. Provisional Application No. 60/072,551 filed Jan. 26, 1998.

TECHNICAL FIELD

The present invention relates to detergent tablets having multiple layers.

BACKGROUND OF THE INVENTION

Detergent compositions in tablet form are known in the art. Detergent compositions in tablet form hold several advantages over detergent compositions in particulate or liquid form, such as ease of handling, transportation and storage. Due to these advantages, detergent compositions in tablet form are becoming increasingly popular with consumers of detergent products.

Detergent tablets are most commonly prepared by premixing the components in the composition and forming the pre-mixed components into a tablet via the use of a tablet press and compression of the components. However, traditional tablet compression processes have significant drawbacks, including but not limited to the fact that selected components of a detergent composition may be adversely affected by the Compression pressure in the tablet press. Accordingly, these selected components were not typically included in prior art detergent tablets without sustaining a loss in performance. In some cases, these selected components may even have become unstable or inactive as a result of the compression.

In addition, as the components of the detergent composition are compressed in the tablet press, they are brought into close proximity with one another resulting in the reaction of selected component, instability, inactivity or exhaustion of the active form of the components.

To avoid the above mentioned drawbacks, prior art detergent tablets have attempted to separate components of the detergent composition that may potentially react with each other when the detergent composition is compressed into tablet form. Separation of the components has been achieved by, for example, preparing multiple-layer tablets wherein the reactive components are contained in different layers of the tablet or encapsulation and coating of reactive components. These prior art multiple-layer tablets are traditionally prepared using multiple compression steps. Accordingly, layers of the tablet which are subjected to more than one compression step may be subjected to a cumulative and potentially greater overall compression pressure. In addition, an increase in compression pressure of the tabletting press is known to decrease the rate of dissolution of the tablet with the effect that such multiple layer tablets may not dissolve satisfactorily in use.

Accordingly, the need remains for an improved detergent tablet which can deliver active detergent ingredients to a domestic wash process thereby delivering superior performance benefits.

SUMMARY OF THE INVENTION

This need is met by the present invention wherein a detergent tablet having a core, a first encapsulating layer, and a second encapsulating layer is provided. The tablet of the present invention delivers detergent components previously considered to be unacceptable for detergent tablets in addition to effectively separating potentially reactive ingredients. In addition, the detergent tablet of the present invention provides superior cleaning performance, particularly in domestic automatic dishwashing machines over the tablets of the prior art.

According to a first embodiment of the present invention, a detergent tablet is provided. The tablet comprises a multi-layered detergent tablet comprising:

a) a core having a first detergent active agent;

b) a first encapsulating layer surrounding said core, having a second detergent active agent, and optionally a disruption system;

c) a second encapsulating layer surrounding said first encapsulating layer, having a third detergent active agent and a disruption system;

wherein disruption of said second encapsulating layer is such that at least 25%, preferably, 35%, more preferably 45%, even more preferably still 50%, of said third detergent active agent is released prior to release of said second detergent active agent, and when first encapsulating layer contains the optionally preferred disruption system, disruption of said first encapsulating layer is such that at least 25%, preferably, 35%, more preferably 45%, even more preferably still 50%, of said second detergent active agent is released prior to release of said first detergent active agent.

According to a second embodiment of the present invention, a detergent tablet is provided. The tablet comprises a multi-layered detergent tablet comprising:

a) a core having a first detergent active agent;

b) a first encapsulating layer surrounding said core, having a second detergent active agent and optionally a disruption system;

c) a second encapsulating layer surrounding said first encapsulating layer, having a third detergent active agent and a disruption system;

wherein disruption of said second encapsulating layer is such that said third detergent active agent is released at least 2 minutes, preferably at least 3 minutes, more preferably at least 5 minutes, even more preferably still at least 10 minutes, prior to release of said second detergent active agent.

According to a third embodiment of the present invention, a detergent tablet is provided. The tablet comprises a multi-layered detergent tablet comprising:

a) a core having a first detergent active agent;

b) a first encapsulating layer surrounding said core, having a second detergent active agent and optionally a disruption system;

c) a second encapsulating layer surrounding said first encapsulating layer, having a third detergent active agent and a disruption system;

wherein disruption of said second encapsulating layer occurs in an aqueous cleaning environment at a temperature of 25° C. or less, preferably 15° C. or less, more preferably 10° C. or less and wherein release of said second detergent active agent occurs in an aqueous cleaning environment at a temperature of 30° C. or greater, preferably 35° C. or greater, more preferably 40° C. or greater.

According to a fourth embodiment of the present invention, a method of washing tableware is provided. The method comprises a washing tableware in a domestic automatic dishwashing appliance, said method comprising treating the soiled tableware in an automatic dishwasher with a multi-layered detergent tablet according to any of the previous embodiments.

Accordingly, it is a further aspect of the present invention to provide a multi-layered detergent tablet which can quickly and efficiently deliver detergent actives to a domestic wash process. These, and other aspects, features and advantages of the present invention will be readily apparent to one of ordinary skill in the art from the following detailed description and the appended claims.

All percentages, ratios and proportions herein are by weight, unless otherwise specified. All temperatures are in degrees Celsius (° C.) unless otherwise specified. All documents cited are in relevant part, incorporated herein by reference.

Definition

"Encapsulating" as used herein means that the layer surrounds totally or encases the previous layer or core. That is, the layer or core which is encapsulated and the detergent active agents in these have no direct access to the outside environment. Access to the outside environment can only happen when the encapsulating layer is removed, either partially or in totality, such as would occur in an aqueous washing environment. For example the second encapsulating layer surrounds totally the first encapsulating layer and none of the second detergent active agent is released until the first encapsulating layer has direct access to the outside environment. This occurs either after a set time or after a quantity of the third detergent active agent has been released.

DETAILED DESCRIPTION OF THE PREFERRED EMBODIMENTS

The present invention comprises a multi-layered detergent tablet and in particular a detergent tablet for automatic dishwashing which has a core, a first encapsulating layer and a second encapsulating layer.

Accordingly, by way of the present invention, detergent active components of a detergent tablet previously adversely affected by the compression pressure used to form the tablets may now be included in a detergent tablet. Examples of these components include bleaching agents and enzymes. In addition, these detergent active components may be separated from one another by having one or more compatible components contained in any one of the core, the first encapsulating layer or the second encapsulating layer of the tablet. Examples of components that may interact and may therefore require separation include bleaching agents, bleach activators or catalyst and enzymes; bleaching agents and bleach catalysts, or activators; bleaching agents and surfactants; alkalinity sources and enzymes.

It may be advantageous to provide that the core, the first encapsulating layer and the second encapsulating layer dissolve in the wash water with different dissolution rates. By controlling the rate of dissolution of each relative to one another, and by selection of the detergent active components in the respective portions, their order of release into the wash water can be controlled and the cleaning performance of the detergent tablet may be improved. For example, it is often preferred that enzymes are delivered to the wash prior to bleaching agent and/or bleach activator. It may also be preferred that a source of alkalinity is released into the wash water more rapidly than other components of the detergent tablet. It is also envisaged that it may be advantageous to prepare a detergent tablet according to the present invention wherein the release of certain components of the tablet is delayed relative to other components. It is also preferred that the first detergent active agent not be released until the rinse cycle, of any washing machine, i.e. laundry or automatic dishwashing machine.

It is preferred that the detergent tablets, of the present invention be free from foul or noxious odors. If present such odors may be masked or removed. This includes the addition of masking agents, perfumes, odor absorbers, such as cyclodextrins, etc.

The detergent tablet can be transparent, opaque or any possible shade in between these two extremes. The core, the first encapsulating layer and the second encapsulating layer can have the same or different degree of transparency, i.e. ranging from totally transparent to opaque. However, it is preferred that they be different. The different layers and core can also be any colour, with each layer being of different colour being preferred.

The detergent tablets described herein are preferably between 15 g and 100 g in weight, more preferably between 18 g and 80 g in weight, even more preferably between 20 g and 60 g in weight. The detergent tablet described herein that are suitable for use in automatic dishwashing methods are most preferably between 20 g and 40 g in weight. Detergent tablets suitable for use in fabric laundering methods are most preferably between 40 g and 100 g, more preferably between 40 g and 80 g, most preferably between 40 g and 65 g in weight.

Form of the Tablet

The core must contain a first detergent active agent but may comprise a mixture of one or more detergent active components. The core can also contain a disruption system. The first encapsulation layer must contain a second detergent active agent but may comprise a mixture of one or more detergent active components. The first encapsulation layer also must contain a disruption system. The second encapsulation layer must contain a third detergent active agent but may comprise a mixture of one or more detergent active components. The second encapsulation layer also must contain a disruption system.

The core, first encapsulating layer and second encapsulating layer can have any physical form which is suitable for use in tablets. That is, for example they can be solids, either compressed or non-compressed, gels, liquids, liquid-gels. Additionally, it is preferred that when any of the core, first encapsulating layer and second encapsulating layer are a solid it is preferred that they be a "compressed solid". By "compressed solid" it is meant that the detergent active agents in the first encapsulating layer, second encapsulating layer or core are combined together, preferably in particulate form, optionally with a carrier or binder(e.g. PEG) and are then compressed using any suitable equipment suitable for forming compressed tablets, blocks, bricks or briquettes; described in more detail hereafter. The multi-layered detergent tablet can be any possible combination of physical forms, for example the core is a liquid or a gel and the first encapsulating layer and second encapsulating layer are solids, which can optionally be a compressed solid. Alternatively, the core could be a solid, either a compressed or non-compressed solid, and the first encapsulating layer and second encapsulating layer are both non-compressed gels.

The compressed solid portions of the detergent tablets described herein have Child Bite Strength (CBS) which is generally greater than 10 Kg, preferably greater than 12 Kg, most preferably greater than 14 Kg. CBS is measured as per the U.S. Consumer Product Safety Commission Test Specification.

Child Bite Strength Test Method: According to this method the tablet is placed horizontally between two strips/ plates of metal. The upper and lower plates are hinged on one side, such that the plates resemble a human jaw. An increasing downward force is applied to the upper plate, mimicking the closing action of the jaw, until the tablet breaks. The CBS of the tablet is a measure of the force in Kilograms, required to break the tablet.

Furthermore, it is preferred that when any of the core, first encapsulating layer and second encapsulating layer are a gel or a liquid gel it is preferred that they be "non-compressed". By "non-compressed" it is meant that the detergent actives in the first encapsulating layer, second encapsulating layer or core are combined together, and are not compressed, described in more detail hereafter.

Compressed Solid

The first encapsulating layer, second encapsulating layer and/or core of the detergent tablet comprises at least one detergent active component but may comprise a mixture of more than one detergent active components, which may optionally be a compressed solid. Any detergent tablet component conventionally used in known detergent tablets is suitable for incorporation into a compressed solid of a detergent tablets of this invention. Suitable detergent active components are described hereinafter. Examples of such detergent active components include, but are not limited to builder, dispersant polymer, colorant, surfactant, bleaching agent, bleach activator, chelants, bleach scavengers, suds suppressing system, bleach catalyst, enzyme, pH buffer, alkalinity source and mixtures thereof.

Non-Compressed

Detergent active components suitable for incorporation in the first encapsulating layer, second encapsulating layer and/or core when these are non-compressed, include components that interact with one or more detergent active components present in the other layers or core. In particular, preferred components when the first encapsulating layer, second encapsulating layer and/or core are non-compressed are those detergent active agents that are adversely affected by compression pressure of for example a compression tablet press. Examples of such detergent active components include, but are not limited to, surfactant, bleaching agent, bleach activator, bleach catalyst, enzyme, corrosion inhibitor, perfume and an alkalinity source. These components are described in more detail below. Furthermore, enzymes in the form of prills can now be included into detergent tablets without the prill being destroyed or damaged during the production of the detergent tablet. The detergent active component(s) may be in any form for example gel or liquid form. The when the first encapsulating layer, second encapsulating layer and/or core are non-compressed in addition to comprising an detergent active component, may also optionally comprise a carrier component. The detergent active component may be present in the form of a solid, gel or liquid, prior to combination with a carrier component.

The when the first encapsulating layer, second encapsulating layer and/or core are non-compressed these portions of the detergent tablet may be in solid, gel, liquid or liquid-gel.

The when the first encapsulating layer, second encapsulating layer and/or core are non-compressed they may comprise particulates, such as powders or granules. The particulates may be prepared by any known method, for example conventional spray drying, granulation, encapsulation or agglomeration. Particulates may be affixed to any compressed solid layer or core by incorporating a binding agent or by forming a coating layer over the first encapsulating layer, second encapsulating layer and/or core.

Where more than one of the core, first encapsulating layer and second encapsulating layer is non-compressed gel these different non-compressed, layers and/or core may comprise particulates having substantially different average particle size. By substantially different average particle size we mean that the difference between the average particle size of the first and second and/or subsequent compositions is greater than 5%, preferably greater than 10%, more preferably greater than 15% or even 20% of the smaller average particle size.

The average particle size of the particulate detergent active components used herein is calculated using a series of Tyler sieves. The series consists of a number of sieves each having a different aperture size. Samples of a composition of detergent active components are sieved through the series of sieves (typically 5 sieves). The weight of a sample of composition retained in the sieve is plotted against the aperture size of the sieve. The average particle size of the composition is defined as the aperture size through which 50% by weight of the sample of composition would pass.

Alternatively, layers and or the core containing more than one detergent active components can have substantially different density. For example, the difference between the density of two detergent active agents in a layer and/or core can be greater than about 5%, more preferably greater than about 10%, even more preferably greater than about 15% or even about 20% of the smaller density. Density of the particulate composition of detergent active components can be measured by any known method suitable for measuring density of particulate material.

Preferably, the density of the composition of detergent active components is measured using a simple funnel and cup device consisting of a conical funnel moulded rigidly on a base and provided with a flap valve at its lower extremity to allow the contents of the funnel to be emptied into an axially aligned cylindrical cup disposed below the funnel. The funnel is 130 mm high and has internal diameters of 130 mm and 40 mm at its respective upper and lower extremities. It is mounted so that the lower extremity is 140 mm above the upper surface of the base. The cup has an overall height of 90 mm, an internal height of 87 mm and an internal diameter of 84 mm. Its nominal volume is 500 ml.

A density measurement is taken by hand pouring the composition into the funnel. Once the funnel is filled, the flap valve is opened and powder allowed to run through the funnel, overfilling the cup. The filled cup is removed from the frame and excess powder removed from the cup by passing a straight edged implement e.g. a knife, across its upper edge. The filled cup is then weighed and the value obtained for the weight of powder doubled to provide a bulk density in grams/litre. Replicate measurements are made as required.

Tablets in which one or more of the core, first encapsulating layer and second encapsulating layer are non-compressed, comprising particulates, the average particle size and/or density will preferably be different in each of the core, first encapsulating layer and second encapsulating layer.

Where the core, first encapsulating layer and/or second encapsulating layer are non-compressed and comprises a solidified melt, the melt is prepared by heating a composition comprising a detergent active component and optional carrier component(s) to above its melting point to form a flowable melt. The flowable melt is then poured into a mould and allowed to cool. As the melt cools it becomes solid, taking the shape of the mould at ambient temperature. If the core of tablet is to be a compressed solid, and the first encapsulating layer is to be non-compressed, then the core is placed into the mould in such a way that the first encapsulating layer totally surrounds the core. Furthermore, the optional carrier(s) and temperature to which the composition is heated to is selected such that it will not significantly alter the active composition, although in some cases, some solvent will transfer into the core. Likewise, when the second encapsulating layer is non-compressed. If the layer or core to be encapsulated by a non-compressed layer is also non-compressed made by a flowable melt then the optional carrier(s) and temperature to which the composition is heated to is selected such that it will not react, cause the core of layer being encapsulated to remelt, harm or alter the composition or performance of the core or the first active agent contained therein. Where the composition comprises one or more carrier components, the carrier component(s) may be heated to above their melting point, and then an detergent active component may be added. Carrier components suitable for preparing a solidified melt are typically non-active components that can be heated to above melting point to form a liquid and cooled to form an intermolecular matrix that can effectively trap detergent active components. A preferred non-active carrier component is an organic polymer that is solid at ambient temperature. Preferably the non-active detergent component is polyethylene glycol (PEG). The compressed portion of the detergent tablet provides at least one mould to accommodate the melt.

The flowable non-compressed, core, first encapsulating layer and/or second encapsulating layer may be in a form comprising a dissolved or suspended detergent active component. The flowable non-compressed, core, first encapsulating layer and/or second encapsulating layer may harden over time to form a solid, semi-solid or highly viscous liquid non-compressed, core, first encapsulating layer and/or second encapsulating layer by any of the methods described above. In particular, the flowable non-compressed, core, first encapsulating layer and/or second encapsulating layer may harden by evaporation of a solvent, or transfer of solvent into the core. Solvents suitable for use herein may include any known solvent in which a binding agent is soluble. Preferred solvents may be polar or non-polar and may include water, alcohol, (for example ethanol, acetone) and alcohol derivatives, with non-polar being the most preferred. In an alternative embodiment more than one solvent may be used.

The flowable non-compressed, core, first encapsulating layer and/or second encapsulating layer may comprise one or more binding agents. Any binding agent that has the effect of causing the composition to become solid, semi-solid or highly viscous over time is envisaged for use herein. Although not wishing to be bound by theory, it is believed that mechanisms by which the binding agent causes a non-solid composition to become solid, semi-solid or highly viscous include: chemical reaction (such as chemical cross linking), or interaction between two or more components of the flowable compositions either; chemical or physical interaction of the binding agent with a component of the composition. Preferred binding agents include a sugar/gelatine combination, starch, glycerol and organic polymers. The sugar may be any monosaccharide (e.g. glucose), disaccharide (e.g. sucrose or maltose) or polysaccharide. The most preferred sugar is commonly available sucrose. For the purposes of the present invention type A or B gelatine may be used, available from for example Sigma. Type A gelatine is preferred since it has greater stability in alkaline conditions in comparison to type B. Preferred gelatine also has a bloom strength of between 65 and 300, most preferably between 75 and 100. Preferred organic polymers include polyethylene glycol (PEG) of molecular weight from 500 to 10,000, preferably from 750 to 8000, most preferably from 1000 to 6000 available from for example from Hoechst. Alternatively, mixtures of high molecular weight PEG, preferably of a molecular weight from 10,000 to 20,000, and low molecular weight PEG, preferably of a molecular weight from 2,000 to 8,000, can be used to maximize processability and hardness.

Where the non-compressed core, first encapsulating layer and/or second encapsulating layer is an extrudate, the extrudate is prepared by premixing the detergent active components with optional carrier components to form a viscous paste. The viscous paste is then extruded using any suitable commonly available extrusion equipment such as for example a single or twin screw extruder available from for example APV Baker, Peterborough, U.K. The extrudate is then formed in to the core, first encapsulating layer and/or second encapsulating layer by conventional processes.

The non-compressed, core, first encapsulating layer and/or second encapsulating layer may additionally contain a drying agent. Any, conventional drying agent can be used. See Vogels Text book of Practical Organic Chemistry, $5^{th}$ Edition (1989) Longman Scientific & Technical, pp. 165–168, incorporated herein by reference. For example, suitable drying agents are anhydrous $CaSO_4$, anhydrous $Na_2SO_4$, sodium sulfite, calcium chloride and $MgSO_4$. The selection of suitable drying agents may depend on the end use of the tablet. A drying agent for a detergent tablet for an automatic dishwashing composition for low temperatures preferably is sodium sulfite, or calcium chloride, but anhydrous $CaSO_4$, may be used for higher use temperatures. When present, drying agents are included in an amount of about 0.1% to about 15%, more preferably from about 0.1% to about 10%, even more preferably from about 0.5% to about 7%, by weight. It is preferred that the drying agent is selected such that it's de-hydration temperature exceeds the process temperature.

When the non-compressed core, first encapsulating layer and/or second encapsulating layer is a gel or a liquid-gel it may include solid ingredients which are dispersed or suspended within the gel. The solid ingredients aid in the control of the viscosity of the gel formulation in conjunction with the thickening system. When included, the non-compressed core, first encapsulating layer and/or second encapsulating layer typically comprises at least about 15% solid ingredients, more preferably at least about 30% solid ingredients and most preferably at least about 40% solid ingredients. However, due to pumpability and other processing concerns, the non-compressed core, first encapsulating layer and/or second encapsulating layer of the present invention typically do not include more than about 90% solid ingredients, when in the form of a gel.

Thickening System

As noted earlier, the detergent tablet of the present invention may comprise a thickening system in the non-compressed core, first encapsulating layer and/or second encapsulating layer when it is a gel, to provide the proper viscosity or thickness of the gel portion. The thickening system typically comprises a non-aqueous liquid diluent and an organic or polymeric gelling additive a) Liquid Diluent The term "diluent" is used herein to connote the liquid portion of the thickening system. While some of the essential and/or optional components of the compositions herein may actually dissolve in the "diluent"-containing phase, other components will be present as particulate material dispersed within the "diluent"-containing phase. Thus the term "diluent" is not meant to require that the solvent material be capable of actually dissolving all of the detergent composition components added thereto. Suitable types of diluent useful in the non-aqueous thickening systems herein include alkylene glycol mono lower alkyl ethers, propylene glycols, ethoxylated or propoxylated ethylene or propylene, glycerol esters, glycerol triacetate, lower molecular weight polyethylene glycols, lower molecular weight methyl esters and amides, and the like, with glycerol triacetate being most preferred.

A preferred type of non-aqueous diluent for use herein comprises the mono-, di-, tri-, or tetra-$C_2$–$C_3$ alkylene glycol mono $C_2$–$C_6$ alkyl ethers. The specific examples of such compounds include diethylene glycol monobutyl ether, tetraethylene glycol monobutyl ether, dipropylene glycol monoethyl ether, and dipropylene glycol monobutyl ether. Diethylene glycol monobutyl ether and dipropylene glycol monobutyl ether are especially preferred. Compounds of the type have been commercially marketed under the trade-names Dowanol, Carbitol, and Cellosolve.

Another preferred type of non-aqueous diluent useful herein comprises the lower molecular weight polyethylene glycols (PEGs). Such materials are those having molecular weights of at least about 150. PEGs of molecular weight ranging from about 200 to 600 are most preferred.

Yet another preferred type of non-aqueous diluent comprises lower molecular weight methyl esters. Such materials are those of the general formula: $R^1$—C(O)—$OCH_3$ wherein $R^1$ ranges from 1 to about 18. Examples of suitable lower molecular weight methyl esters include methyl acetate, methyl propionate, methyl octanoate, and methyl dodecanoate.

The non-aqueous organic diluent(s) employed should, of course, be compatible and non-reactive with other composition components, e.g., enzymes, used in the detergent tablets herein. Such a diluent component will generally be utilized in an amount of from about 10% to about 60% by weight of the composition. More preferably, the non-aqueous, low-polarity organic diluent will comprise from about 20% to about 50% by weight of the composition, most preferably from about 30% to about 50% by weight of the composition.

b) Gelling Additive

As noted earlier, a gelling agent or additive is added to the non aqueous diluent of the present invention to complete the thickening system. To form the gel required for suitable phase stability and acceptable rheology of the non-compressed, non-encapsulating portion, the organic gelling agent is generally present to the extent of a ratio of diluent to gelling agent in thickening system typically ranging from about 99:1 to about 1:1 More preferably, the ratios range from about 19:1 to about 4:1.

The preferred gelling agents of the present invention are selected from castor oil derivatives, propylene glycol, polyethylene glycol, sorbitols and related organic thixatropes, organoclays, cellulose and cellulose derivatives, pluronics, stearates and stearate derivatives, sugar/gelatin combination, starches, glycerol, organic acid amides such as N-lauryl-L-glutamic acid di-n-butyl amide and mixtures thereof.

The preferred gelling agents are castor oil derivatives. Castor oil is a naturally occurring triglyceride obtained from the seeds of Ricinus Communis, a plant which grows in most tropical or subtropical areas. The primary fatty acid moiety in the castor oil triglyceride is ricinoleic acid (12-hydroxy oleic acid). It accounts for about 90% of the fatty acid moieties. The balance consists of dihydroxystearic, palmitic, stearic, oleic, linoleic, linolenic and eicosanoic moieties. Hydrogenation of the oil (e.g., by hydrogen under pressure) converts the double bonds in the fatty acid moieties to single bonds, thus "hardening" the oil. The hydroxyl groups are unaffected by this reaction.

The resulting hydrogenated castor oil, therefore, has an average of about three hydroxyl groups per molecule. It is believed that the presence of these hydroxyl groups accounts in large part for the outstanding structuring properties which are imparted to the non-compressed core, first encapsulating layer and/or second encapsulating layer compared to similar liquid detergent compositions which do not contain castor oil with hydroxyl groups in their fatty acid chains. For use in the compositions of the present invention the castor oil should be hydrogenated to an iodine value of less than about 20, and preferably less than about 10. Iodine value is a measure of the degree of unsaturation of the oil and is measured by the "Wijis Method," which is well-known in the art. Unhydrogenated castor oil has an iodine value of from about 80 to 90.

Hydrogenated castor oil is a commercially available commodity being sold, for example, in various grades under the trademark CASTORWAX.RTM. by NL Industries, Inc., Highstown, N.J. Other Suitable hydrogenated castor oil derivatives are Thixcin R, Thixcin E, Thixatrol ST, Perchem R and Perchem ST, made by Rheox, Laporte. Especially preferred is Thixatrol ST.

Polyethylene glycols when employed as gelling agents, rather than solvents, are low molecular weight materials, having a molecular weight range of from about 1,000 to about 20,000, preferably, about 2000 to about 12,000, with 4,000 to 10,000 being the most preferred.

Cellulose and cellulose derivatives when employed in the present invention preferably include: i) Cellulose acetate and Cellulose acetate phthalate (CAP); ii) Hydroxypropyl Methyl Cellulose (HPMC); iii)Carboxymethylcellulose (CMC); and mixtures thereof The hydroxypropyl methylcellulose polymer preferably has a number average molecular weight of about 50,000 to 125,000 and a viscosity of a 2 wt. % aqueous solution at 25° C. (ADTMD2363) of about 50,000 to about 100,000 cps. An especially preferred hydroxypropyl cellulose polymer is Methocele® J75MS-N wherein a 2.0 wt. % aqueous solution at 25° C. has a viscosity of about 75,000 cps.

The sugar may be any monosaccharide (e.g. glucose), disaccharide (e.g. sucrose or maltose) or polysaccharide. The most preferred sugar is commonly available sucrose. For the purposes of the present invention type A or B gelatin may be used, available from for example Sigma. Type A gelatin is preferred since it has greater stability in alkaline conditions in comparison to type B. Preferred gelatin also has a bloom strength of between 65 and 300, most preferably between 75 and 100.

However, the polyethylene glycol's are the preferred gelling agents.

The non-compressed core, first encapsulating layer and/or second encapsulating layer of the present invention may include a variety of other ingredients in addition to the thickening agent as herein before described and the detergent active disclosed in more detail below. Ingredients such as perfumes and dyes may be included as well as swelling/adsorbing agents such as carboxymethylcelluloses and starches to aid in adsorption of excess diluent or aid in the dissolution or breakup of the non-compressed core, first encapsulating layer and/or second encapsulating layer in the wash. In addition, hardness modifying agents may incorporated into the thickening system to adjust the hardness of the gel if desired. These hardness control agents are typically selected from various polymers and polyethylene glycol's and when included are typically employed in levels of less than about 20% and more preferably less than about 10% by weight of the solvent in the thickening system. For example, hardening agents, such as high molecular weight PEG, preferably of a molecular weight from 10,000 to 20,000, can be added to decrease the hardening time of the non-compressed core, first encapsulating layer and/or second encapsulating layer.

When it is a gel or a liquid-gel the non-compressed core, first encapsulating layer and/or second encapsulating layer of the present invention is formulated so that the gel is a pumpable, flowable gel at slightly elevated temperatures of around 30° C. or greater to allow increased flexibility in producing the detergent tablet, but becomes highly viscous or hardens at ambient temperatures so that the form of the detergent tablet is maintained through shipping and handling of the detergent tablet. Such hardening of the non-compressed core, first encapsulating layer and/or second encapsulating layer may achieved, for example, by (i) by cooling to below the flowable temperature of the gel; (ii) by evaporation of the diluent; or by (iii) by polymerization of the gelling agent. Preferably, the gel is formulated such that the gel hardens to sufficiently so that the maximum force needed to push a probe into the dimple preferably ranges from about 0.5N to about 40N. This force may be characterized by measuring the maximum force needed to push a probe, fitted with a strain gauge, a set distance into the gel. The set distance may be between 40 and 80% of the total gel depth. This force can be measured on a QTS 25 tester, using a probe of 5 mm diameter. Typical forces measured are in the range of 1N to 25N.

Coating

In a preferred embodiment the non-compressed, core, first encapsulating layer and/or second encapsulating layer is coated with a coating layer. The coating may be used to affix a non-compressed, first encapsulating layer and/or second encapsulating layer to the compressed solid or non-compressed core and/or first encapsulating layer. This may be particularly advantageous where the non-compressed, first encapsulating layer and/or second encapsulating layer comprises flowable particulates, gels or liquids.

Where present the coating layer generally present at a level of preferably at least about 0.05%, more preferably at least about 0.1%, even more preferably at least about 1%, even more preferably still at least about 2% or even at least about 5% of the core, first encapsulating layer or second encapsulating layer. However, when the detergent tablet is an automatic dishwashing composition, it is preferred that the coating not be a fatty acid.

As an alternative embodiment the coating layer may encapsulate the multi-layered detergent tablet. In this embodiment the coating layer is present at a level of at least about 4%, more preferably at least about 5%, most preferably at least about 10% of the detergent tablet.

The first encapsulating layer, second encapsulating layer and/or core may also be provided with a coating of a water-soluble material to protect it. The coating layer preferably comprises a material that becomes solid on contact preferably within less than 15 minutes, more preferably less than 10 minutes, even more preferably less than 5 minutes, most preferably less than 60 seconds. Preferably the coating layer is water-soluble. Preferred coating layers comprise materials selected from the group consisting of fatty acids, alcohols, diols, esters and ethers, adipic acid, carboxylic acid, dicarboxylic acid, polyvinyl acetate (PVA), polyvinyl pyrrolidone (PVP), polyacetic acid, polyethylene glycol (PEG) and mixtures thereof. Preferred carboxylic or dicarboxylic acids preferably comprise an even number of carbon atoms. Preferably carboxylic or dicarboxylic acids comprise at least 4, more preferably at least 6, even more preferably at least 8 carbon atoms, most preferably between 8 and 13 carbon atoms. Preferred dicarboxylic acids include adipic acid, suberic acid, azelaic acid, subacic acid, undecanedioic acid, dodecanedioic acid, tridecanedioic and mixtures thereof. Preferred fatty acids are those having a carbon chain length of from C12 to C22, most preferably from C18 to C22. The coating layer may also preferably comprise a disrupting agent. Where present the coating layer generally present at a level of at least 0.05%, preferably at least 0.1%, more preferably at least 1%, most preferably at least 2% or even at least 5% of the detergent tablet. However, when the detergent tablet is an automatic dishwashing composition, the coating can not be a fatty acid.

Disruption System

The first encapsulating layer and the second encapsulating layer must contain a disruption system. The core can optionally contain a disruption system. The disrupting system may be a disintegrating or effervescing agent. Suitable disintegrating agents include agents that swell on contact with water or facilitated water influx and/or efflux by forming channels in compressed and/or non-compressed, non-encapsulating portions. Any known disintegrating or effervescing agent suitable for use in laundry or dishwashing applications is envisaged for use herein. Suitable disintegrating agent include starch, starch derivatives, alginates, carboxymethylcellulose (CMC), cellulosic-based polymers, sodium acetate, aluminium oxide. Suitable effervescing agents are those that produce a gas on contact with water. Suitable effervescing agents may be oxygen, nitrogen dioxide or carbon dioxide evolving species. Examples of preferred effervescing agents may be selected from the group consisting of perborate, percarbonate, carbonate, bicarbonate and carboxylic acids such as citric or maleic acid.

An advantage of including a disrupting system in the detergent tablet of the present invention is the transport, storage and handling benefits that can be achieved by increasing the hardness of the detergent tablet without adversely affecting the cleaning performance.

Detergent Active Agents

The core must contain a first detergent active agent. The first encapsulating layer must contain a second detergent active agent. The second encapsulating layer must contain a third detergent active agent. These three detergent active agents can be any conventional ingredient used in cleaning compositions, such as laundry and automatic dishwashing compositions.

When the detergent active agent is in a layer or core which is a compressed solid the detergent active agent can be a variety of ingredients including builders, surfactants, enzymes, bleaching agents, alkalinity sources, colorants, perfume, lime soap dispersants, organic polymeric compounds for example, polymeric dye transfer inhibiting agents and polymeric dispersants; crystal growth inhibitors, heavy metal ion sequestrants, chelants, bleach scavengers, metal ion salts, enzyme stabilizers, corrosion inhibitors, suds suppressers, solvents, fabric softening agents, optical brighteners, hydrotropes.

When the detergent active agent is in a layer or core which is non-compressed the detergent active agent can be a variety of ingredients including surfactants, enzymes, enzyme prills, bleaching agents, polymeric dispersants, alkalinity sources, colorants, perfume, chelants, bleach scavengers, silver care agents, enzyme stabilizers, corrosion inhibitors, suds suppressers, builders. The detergent active agents in a compressed solid are typically builders, surfactants, silicates, pH control agents or buffers, chelants, bleach scavengers, polymeric dispersants, enzymes and bleaching agents. The following is a description of the detergent actives useful in the present invention.

Surfactants

Suitable surfactants are selected from anionic, cationic, nonionic ampholytic and zwitterionic surfactants and mixtures thereof. Automatic dishwashing machine products should be low foaming in character and thus the foaming of the surfactant system for use in dishwashing methods must be suppressed or more preferably be low foaming, typically nonionic in character. Sudsing caused by surfactant systems used in laundry cleaning methods need not be suppressed to the same extent as is necessary for dishwashing.

A typical listing of anionic, nonionic, ampholytic and zwitterionic classes, and species of these surfactants, is given in U.S. Pat. No. 3,929,678 issued to Laughlin and Heuring on Dec., 30, 1975. A list of suitable cationic surfactants is given in U.S. Pat. No. 4,259,217 issued to Murphy on Mar. 31, 1981. A listing of surfactants typically included in automatic dishwashing detergent compositions is given for example, in EP-A-0414 549 and PCT Applications Nos. WO 93/08876 and WO 93/08874.

Detersive surfactants included in the fully-formulated detergent compositions afforded by the present invention comprises at least 0.01%, preferably from about 0.5% to about 50%, by weight of detergent composition depending upon the particular surfactants used and the desired effects. In a highly preferred embodiment, the detersive surfactant comprises from about 0.5% to about 20% by weight of the composition.

The detersive surfactant can be nonionic, anionic, ampholytic, zwitterionic, or cationic. Mixtures of these surfactants can also be used. Preferred detergent compositions comprise anionic detersive surfactants or mixtures of anionic surfactants with other surfactants, especially nonionic surfactants.

Nonionic Surfactants

Particularly preferred surfactants in the preferred automatic dishwashing compositions (ADD) of the present invention are low foaming nonionic surfactants (LFNI). LFNI may be present in amounts from 0.01% to about 10% by weight, preferably from about 0.1% to about 10%, and most preferably from about 0.25% to about 4%. LFNIs are most typically used in ADDs on account of the improved water-sheeting action (especially from glass) which they confer to the ADD product. They also encompass non-silicone, non-phosphate polymeric materials further illustrated hereinafter which are known to defoam food soils encountered in automatic dishwashing.

Preferred LFNIs include nonionic alkoxylated surfactants, especially ethoxy-lates derived from primary alcohols, and blends thereof with more sophisticated surfactants, such as the polyoxypropylene/polyoxyethylene/polyoxypropylene (PO/EO/PO) reverse block polymers. The PO/EO/PO polymer-type surfactants are well-known to have foam suppressing or defoaming action, especially in relation to common food soil ingredients such as egg.

The invention encompasses preferred embodiments wherein LFNI is present, and wherein this component is solid at about 95° F. (35° C.), more preferably solid at about 77° F. (25° C.). For ease of manufacture, a preferred LFNI has a melting point between about 77° F. (25° C.) and about 140° F. (60° C.), more preferably between about 80° F. (26.6° C.) and 110° F. (43.3° C.).

In a preferred embodiment, the LFNI is an ethoxylated surfactant derived from the reaction of a monohydroxy alcohol or alkylphenol containing from about 8 to about 20 carbon atoms, with from about 6 to about 15 moles of ethylene oxide per mole of alcohol or alkyl phenol on an average basis.

A particularly preferred LFNI is derived from a straight chain fatty alcohol containing from about 16 to about 20 carbon atoms ($C_{16}$–$C_{20}$ alcohol), preferably a $C_{18}$ alcohol, condensed with an average of from about 6 to about 15 moles, preferably from about 7 to about 12 moles, and most preferably from about 7 to about 9 moles of ethylene oxide per mole of alcohol. Preferably the ethoxylated nonionic surfactant so derived has a narrow ethoxylate distribution relative to the average.

The LFNI can optionally contain propylene oxide in an amount up to about 15% by weight. Other preferred LFNI surfactants can be prepared by the processes described in U.S. Pat. No. 4,223,163, issued Sep. 16, 1980, Builloty, incorporated herein by reference.

Highly preferred ADDs herein wherein the LFNI is present make use of ethoxylated monohydroxy alcohol or alkyl phenol and additionally comprise a polyoxyethylene, polyoxypropylene block polymeric compound; the ethoxylated monohydroxy alcohol or alkyl phenol fraction of the LFNI comprising from about 20% to about 100%, preferably from about 30% to about 70%, of the total LFNI.

Suitable block polyoxyethylene-polyoxypropylene polymeric compounds that meet the requirements described hereinbefore include those based on ethylene glycol, propylene glycol, glycerol, trimethylolpropane and ethylenediamine as initiator reactive hydrogen compound. Polymeric compounds made from a sequential ethoxylation and propoxylation of initiator compounds with a single reactive hydrogen atom, such as $C_{12-18}$ aliphatic alcohols, do not generally provide satisfactory suds control in the instant ADDs. Certain of the block polymer surfactant compounds designated PLURONIC® and TETRONIC® by the BASE-Wyandotte Corp., Wyandotte, Mich., are suitable in ADD compositions of the invention.

A particularly preferred LFNI contains from about 40% to about 70% of a polyoxypropylene/polyoxyethylene/polyoxypropylene block polymer blend comprising about 75%, by weight of the blend, of a reverse block co-polymer of polyoxyethylene and polyoxypropylene containing 17 moles of ethylene oxide and 44 moles of propylene oxide; and about 25%, by weight of the blend, of a block co-polymer of polyoxyethylene and polyoxypropylene initiated with trimethylolpropane and containing 99 moles of propylene oxide and 24 moles of ethylene oxide per mole of trimethylolpropane.

Suitable for use as LFNI in the ADD compositions are those LFNI having relatively low cloud points and high hydrophilic-lipophilic balance (HLB). Cloud points of 1% solutions in water are typically below about 32° C. and preferably lower, e.g., 10° C., for optimum control of sudsing throughout a full range of water temperatures.

LFNIs which may also be used include those POLY-TERGENT® SLF-18 nonionic surfactants from Olin Corp., and any biodegradable LFNI having the melting point properties discussed hereinabove.

These and other nonionic surfactants are well known in the art, being described in more detail in Kirk Othmer's Encyclopedia of Chemical Technology, 3rd Ed., Vol. 22, pp. 360–379, "Surfactants and Detersive Systems", incorporated by reference herein.

Preferred are ADD compositions comprising mixed surfactants wherein the sudsing (absent any silicone suds controlling agent) is less than 2 inches, preferably less than 1 inch, as determined by the disclosure below.

The equipment useful for these measurements are: a Whirlpool Dishwasher (model 900) equipped with clear plexiglass door, IBM computer data collection with Labview and Excel Software, proximity sensor (Newark Corp.—model 95F5203) using SCXI interface, and a plastic ruler.

The data is collected as follows. The proximity sensor is affixed to the bottom dishwasher rack on a metal bracket. The sensor faces downward toward the rotating dishwasher arm on the bottom of the machine (distance approximately 2 cm. from the rotating arm). Each pass of the rotating arm is measured by the proximity sensor and recorded. The pulses recorded by the computer are converted to rotations per minute (RPM) of the bottom arm by counting pulses over a 30 second interval. The rate of the arm rotation is directly proportional to the amount of suds in the machine and in the dishwasher pump (i.e., the more suds produced, the slower the arm rotation).

The plastic ruler is clipped to the bottom rack of the dishwasher and extends to the floor of the machine. At the end of the wash cycle, the height of the suds is measured using the plastic ruler (viewed through the clear door) and recorded as suds height.

The following procedure is followed for evaluating ADD compositions for suds production as well as for evaluating nonionic surfactants for utility. (For separate evaluation of nonionic surfactant, a base ADD formula, such as Cascade powder, is used along with the nonionic surfactants which are added separately in glass vials to the dishwashing machine.)

First, the machine is filled with water (adjust water for appropriate temperature and hardness) and proceed through a rinse cycle. The RPM is monitored throughout the cycle (approximately 2 min.) without any ADD product (or surfactants) being added (a quality control check to ensure the machine is functioning properly). As the machine begins to fill for the wash cycle, the water is again adjusted for temperature and hardness, and then the ADD product is added to the bottom of the machine (in the case of separately evaluated surfactants, the ADD base formula is first added to the bottom of the machine then the surfactants are added by placing the surfactant-containing glass vials inverted on the top rack of the machine). The RPM is then monitored throughout the wash cycle. At the end of the wash cycle, the suds height is recorded using the plastic ruler. The machine is again filled with water (adjust water for appropriate temperature and hardness) and runs through another rinse cycle. The RPM is monitored throughout this cycle.

An average RPM is calculated for the 1st rinse, main wash, and final rinse. The % RPM efficiency is then calculated by dividing the average RPM for the test surfactants into the average RPM for the control system (base ADD formulation without the nonionic surfactant). The RPM efficiency and suds height measurements are used to dimension the overall suds profile of the surfactant.

Nonionic Ethoxylated Alcohol Surfactant

The alkyl ethoxylate condensation products of aliphatic alcohols with from about 1 to about 25 moles of ethylene oxide are suitable for use herein. The alkyl chain of the aliphatic alcohol can either be straight or branched, primary or secondary, and generally contains from 6 to 22 carbon atoms. Particularly preferred are the condensation products of alcohols having an alkyl group containing from 8 to 20 carbon atoms with from about 2 to about 10 moles of ethylene oxide per mole of alcohol.

End-capped Alkyl Alkoxylate Surfactant

A suitable endcapped alkyl alkoxylate surfactant is the epoxy-capped poly(oxyalkylated) alcohols represented by the formula:

$$R_1O[CH_2CH(CH_3)O]_x[CH_2CH_2O]_y[CH_2CH(OH)R_2] \quad (I)$$

wherein $R_1$ is a linear or branched, aliphatic hydrocarbon radical having from about 4 to about 18 carbon atoms; $R_2$ is a linear or branched aliphatic hydrocarbon radical having from about 2 to about 26 carbon atoms; x is an integer having an average value of from about 0.5 to about 1.5, more preferably about 1; and y is an integer having a value of at least about 15, more preferably at least about 20.

Preferably, the surfactant of formula I, at least about 10 carbon atoms in the terminal epoxide unit $[CH_2CH(OH)R_2]$. Suitable surfactants of formula I, according to the present invention, are Olin Corporation's POLY-TERGENT® SLF-18B nonionic surfactants, as described, for example, in WO 94/22800, published Oct. 13, 1994 by Olin Corporation.

Ether-Capped Poly(oxyalkvlated) Alcohols

Preferred surfactants for use herein include ether-capped poly(oxyalkylated) alcohols having the formula:

$$R^1O[CH_2CH(R^3)O]_x[CH_2]_kCH(OH)[CH_2]_jOR^2$$

wherein $R^1$ and $R^2$ are linear or branched, saturated or unsaturated, aliphatic or aromatic hydrocarbon radicals having from about 1 to about 30 carbon atoms; $R^3$ is H, or a linear aliphatic hydrocarbon radical having from about 1 to about 4 carbon atoms; x is an integer having an average value from about 1 to about 30, wherein when x is about 2 or greater $R^3$ may be the same or different and k and j are integers having an average value of from about 1 to about 12, and more preferably about 1 to about 5.

$R^1$ and $R^2$ are preferably linear or branched, saturated or unsaturated, aliphatic or aromatic hydrocarbon radicals having from about 6 to about 22 carbon atoms with about 8 to about 18 carbon atoms being most preferred. H or a linear aliphatic hydrocarbon radical having from 1 to 2 carbon atoms is most preferred for $R^3$. Preferably, x is an integer having an average value of from about 1 to about 20, more preferably from about 6 to about 15.

As described above, when, in the preferred embodiments, and x is greater than 2, $R^3$ may be the same or different. That is, $R^3$ may vary between any of the alklyeneoxy units as described above. For instance, if x is 3, $R^3$may be selected to form ethlyeneoxy(EO) or propyleneoxy(PO) and may vary in order of (EO)(PO)(EO), (EO)(EO)(PO); (EO)(EO)(EO); (PO)(EO)(PO); (PO)(PO)(EO) and (PO)(PO)(PO). Of course, the integer three is chosen for example only and the variation may be much larger with a higher integer value for x and include, for example, multiple (EO) units and a much small number of (PO) units.

Particularly preferred surfactants as described above include those that have a low cloud point of less than about 20° C. These low cloud point surfactants may then be employed in conjunction with a high cloud point surfactant as described in detail below for superior grease cleaning benefits.

Most preferred ether-capped poly(oxyalkylated) alcohol surfactants are those wherein k is 1 and j is 1 so that the surfactants have the formula:

$R^1O[CH_2CH(R^3)O]_xCH_2CH(OH)CH_2OR^2$ where $R^1$, $R^2$ and $R^3$ are defined as above and x is an integer with an average value of from about 1 to about 30, preferably from about 1 to about 20, and even more preferably from about 6 to about 18. Most preferred are surfactants wherein $R^1$ and $R^2$ range from about 9 to about 14, $R^3$ is H forming ethyleneoxy and x ranges from about 6 to about 15.

The ether-capped poly(oxyalkylated) alcohol surfactants comprise three general components, namely a linear or branched alcohol, an alkylene oxide and an alkyl ether end cap. The alkyl ether end cap and the alcohol serve as a hydrophobic, oil-soluble portion of the molecule while the alkylene oxide group forms the hydrophilic, water-soluble portion of the molecule.

These surfactants exhibit significant improvements in spotting and filming characteristics and removal of greasy soils, when used in conjunction with high cloud point surfactants, relative to conventional surfactants.

Generally speaking, the ether-capped poly(oxyalkylene) alcohol surfactants of the present invention may be produced by reacting an aliphatic alcohol with an epoxide to form an ether which is then reacted with a base to form a second epoxide. The second epoxide is then reacted with an alkoxylated alcohol to form the novel compounds of the present invention. Examples of methods of preparing the ether-capped poly(oxyalkylated) alcohol surfactants are described below:

Preparation of $C_{12/14}$ Alkyl Glycidyl Ether

A $C_{12/14}$ fatty alcohol (100.00 g, 0.515 mol.) and tin (IV) chloride (0.58 g, 2.23 mmol, available from Aldrich) are combined in a 500 mL three-necked round-bottomed flask fitted with a condenser, argon inlet, addition funnel, magnetic stirrer and internal temperature probe. The mixture is heated to 60° C. Epichlorhydrin (47.70 g, 0.515 mol, available from Aldrich) is added dropwise so as to keep the temperature between 60–65° C. After stirring an additional hour at 60° C., the mixture is cooled to room temperature. The mixture is treated with a 50% solution of sodium hydroxide (61.80 g, 0.773 mol, 50%) while being stirred mechanically. After addition is completed, the mixture is heated to 90° C. for 1.5 h, cooled, and filtered with the aid of ethanol. The filtrate is separated and the organic phase is washed with water (100 mL), dried over $MgSO_4$, filtered, and concentrated. Distillation of the oil at 100–120° C. (0.1 mm Hg) providing the glycidyl ether as an oil.

Preparation of $C_{12/14}$ alkyl-$C_{9/11}$ ether Capped Alcohol Surfactant

Neodol® 91-8 (20.60 g, 0.0393 mol ethoxylated alcohol available from the Shell chemical Co.) and tin (IV) chloride (0.58 g, 2.23 mmol) are combined in a 250 mL three-necked round-bottomed flask fitted with a condenser, argon inlet, addition funnel, magnetic stirrer and internal temperature probe. The mixture is heated to 60 ° C. at which point $C_{12/14}$ alkyl glycidyl ether (11.00 g, 0.0393 mol) is added dropwise over 15 min. After stirring for 18 h at 60° C., the mixture is cooled to room temperature and dissolved in an equal portion of dichloromethane. The solution is passed through a 1 inch pad of silica gel while eluting with dichloromethane. The filtrate is concentrated by rotary evaporation and then stripped in a kugelrohr oven (100° C., 0.5 mm Hg) to yield the surfactant as an oil.

For more details on these and other suitable nonionic surfactants see U.S. patent application Ser. Nos. 60/054,702, 60/054,688 and 60/057,025 all of which are incorporated herein by reference.

Nonionic Ethoxylated/Propoxylated Fatty Alcohol Surfactant

The ethoxylated $C_6$–$C_{18}$ fatty alcohols and $C_6$–$C_{18}$ mixed ethoxylated/propoxylated fatty alcohols are suitable surfactants for use herein, particularly where water soluble. Preferably the ethoxylated fatty alcohols are the $C_{10}$–$C_{18}$ ethoxylated fatty alcohols with a degree of ethoxylation of from about 3 to about 50, most preferably these are the $C_{12}$–$C_{18}$ ethoxylated fatty alcohols with a degree of ethoxylation from about 3 to about 40. Preferably the mixed ethoxylated/propoxylated fatty alcohols have an alkyl chain length of from about 10 to about 18 carbon atoms, a degree of ethoxylation of from 3 to 30 and a degree of propoxylation of from about 1 to about 10.

Nonionic EO/PO Condensates with Propylene Glycol

The condensation products of ethylene oxide with a hydrophobic base formed by the condensation of propylene oxide with propylene glycol are suitable for use herein. The hydrophobic portion of these compounds preferably has a molecular weight of from about 1500 to about 1800 and exhibits water insolubility. Examples of compounds of this type include certain of the commercially-available Pluronic™ surfactants, marketed by BASF.

Nonionic EO Condensation Products with Propylene Oxide/ethylene Diamine Adducts

The condensation products of ethylene oxide with the product resulting from the reaction of propylene oxide and ethylenediamine are suitable for use herein. The hydrophobic moiety of these products consists of the reaction product of ethylenediamine and excess propylene oxide, and generally has a molecular weight of from about 2500 to about 3000. Examples of this type of nonionic surfactant include certain of the commercially available Tetronic compounds, marketed by BASF.

Mixed Nonionic Surfactant System

In a preferred embodiment of the present invention the detergent tablet comprises a mixed nonionic surfactant system comprising at least one low cloud point nonionic surfactant and at least one high cloud point nonionic surfactant.

"Cloud point", as used herein, is a well known property of nonionic surfactants which is the result of the surfactant becoming less soluble with increasing temperature, the temperature at which the appearance of a second phase is observable is referred to as the "cloud point" (See Kirk Othmer's Encyclopedia of Chemical Technology, 3rd Ed. Vol. 22, pp. 360–379).

As used herein, a "low cloud point" nonionic surfactant is defined as a nonionic surfactant system ingredient having a cloud point of less than about 30° C., preferably less than about 20° C., and most preferably less than about 10° C. Typical low cloud point nonionic surfactants include nonionic alkoxylated surfactants, especially ethoxylates derived from primary alcohol, and polyoxypropyl-ene/polyoxyethylene/polyoxypropylene (PO/EO/PO) reverse block polymers. Also, such low cloud point nonionic surfactants include, for example, ethoxylated-propoxylated alcohol (e.g., Olin Corporation's Poly-Tergent® SLF18), epoxy-capped poly(oxyalkylated) alcohols (e.g., Olin Corporation's Poly-Tergent(® SLF18B series of nonionics, as described, for example, in WO 94/22800, published Oct. 13, 1994 by Olin Corporation)and the ether-capped poly (oxyalkylated) alcohol surfactants.

Nonionic surfactants can optionally contain propylene oxide in an amount up to about 15% by weight. Other preferred nonionic surfactants can be prepared by the processes described in U.S. Pat. No. 4,223,163, issued Sep. 16, 1980, Builloty, incorporated herein by reference.

Low cloud point nonionic surfactants additionally comprise a polyoxyethylene, polyoxypropylene block polymeric compound. Block polyoxyethylene-polyoxypropylene polymeric compounds include those based on ethylene glycol, propylene glycol, glycerol, trimethylolpropane and ethylenediamine as initiator reactive hydrogen compound. Certain of the block polymer surfactant compounds designated PLURONIC®, REVERSED PLURONIC®, and TETRONIC ® by the BASF-Wyandotte Corp., Wyandotte, Mich., are suitable in ADD compositions of the invention. Preferred examples include REVERSED PLURONIC® 25R2 and TETRONIC® 702, Such surfactants are typically useful herein as low cloud point nonionic surfactants.

As used herein, a "high cloud point" nonionic surfactant is defined as a nonionic surfactant system ingredient having a cloud point of greater than about 40° C., preferably greater than about 50° C., and more preferably greater than about 60° C. Preferably the nonionic surfactant system comprises an ethoxylated surfactant derived from the reaction of a monohydroxy alcohol or alkylphenol containing from about 8 to about 20 carbon atoms, with from about 6 to about 15 moles of ethylene oxide per mole of alcohol or alkyl phenol on an average basis. Such high cloud point nonionic surfactants include, for example, Tergitol 15S9 (supplied by Union Carbide), Rhodasurf TMD 8.5 (supplied by Rhone Poulenc), and Neodol 91-8 (supplied by Shell).

It is also preferred for purposes of the present invention that the high cloud point nonionic surfactant further have a hydrophile-lipophile balance ("HLB"; see Kirk Othmer hereinbefore) value within the range of from about 9 to about 15, preferably about 11 to about 15. Such materials include, for example, Tergitol 15S9 (supplied by Union Carbide), Rhodasurf TMD 8.5 (supplied by Rhone Poulenc), and Neodol 91-8 (supplied by Shell).

Another preferred high cloud point nonionic surfactant is derived from a straight or preferably branched chain or secondary fatty alcohol containing from about 6 to about 20 carbon atoms ($C_6$–$C_{20}$ alcohol), including secondary alcohols and branched chain primary alcohols. Preferably, high cloud point nonionic surfactants are branched or secondary alcohol ethoxylates, more preferably mixed C9/11 or C11/15 branched alcohol ethoxylates, condensed with an average of from about 6 to about 15 moles, preferably from about 6 to about 12 moles, and most preferably from about 6 to about 9 moles of ethylene oxide per mole of alcohol. Preferably the ethoxylated nonionic surfactant so derived has a narrow ethoxylate distribution relative to the average.

In a preferred embodiment the detergent tablet comprising such a mixed surfactant system also comprises an amount of water-soluble salt to provide conductivity in deionized water measured at 25° C. greater than 3 milli Siemens/cm, preferably greater than 4 milli Siemens/cm, most preferably greater than 4.5 milli Siemens/cm as described in U.S. application Ser. No. 09/254727, filed Sep. 10, 1997 now abandoned.

In another preferred embodiment the mixed surfactant system dissolves in water having a hardness of 1.246 mmol/L in any suitable cold-fill automatic dishwasher to provide a solution with a surface tension of less than 4 Dynes/cm at less than 45° C., preferably less than 40° C., most preferably less than 35° C. as described in U.S. Pat. No. 6,013,613, issued Jan. 11, 2000 to Scheper et al.

In another preferred embodiment the high cloud point and low cloud point surfactants of the mixed surfactant system are separated such that one of either the high cloud point or low cloud point surfactants is present in a first matrix and the other is present in a second matrix as described in U.S. Pat. No. 6,013,613, issued Jan. 11, 2000 to Scheper et al. For the purposes of the present invention, the first matrix may be a first particulate and the second matrix may be a second particulate. A surfactant may be applied to a particulate by any suitable known method, preferably the surfactant is sprayed onto the particulate. In a preferred aspect the first matrix is the core or the first encapsulating layer and the second matrix is the first encapsulating layer or the second encapsulating layer of the detergent tablet of the present invention. Preferably the low cloud point surfactant is present in the core or the first encapsulating layer and the high cloud point surfactant is present in the first encapsulating layer or the second encapsulating layer of the detergent tablet of the present invention.

Also suitable are the branched nonionic surfactants disclosed in co-pending U.S. patent application Ser. No. 60/031,917 all of which is incorporated herein by reference. These branched nonionic surfactants show some in applications improved spotting and filming benefits over conventional linear surfactants.

Anionic Surfactant

Essentially any anionic surfactants useful for detersive purposes are suitable. These can include salts (including, for example, sodium, potassium, ammonium, and substituted ammonium salts such as mono-, di- and triethanolamine salts) of the anionic sulfate, sulfonate, carboxylate and sarcosinate surfactants. Anionic sulfate surfactants are preferred.

Nonlimiting examples of surfactants useful herein include the conventional $C_{11}$–$C_{18}$ linear or branched alkyl benzene sulfonates and primary, secondary, linear, branched and random alkyl sulfates, the $C_{10}$–$C_{18}$ alkyl alkoxy sulfates, the $C_{10}$–$C_{18}$ alkyl polyglycosides and their corresponding sulfated polyglycosides, $C_{12}$–$C_{18}$ alpha-sulfonated fatty acid esters, $C_{12}$–$C_{18}$ alkyl and alkyl phenol alkoxylates (especially ethoxylates and mixed ethoxy/propoxy), $C_{12}$–$C_{18}$ betaines and sulfobetaines ("sultaines"), $C_{10}$–$C_{18}$ amine oxides, and the like. Other conventional useful surfactants are listed in standard texts.

Other anionic surfactants include the isethionates such as the acyl isethionates, N-acyl taurates, fatty acid amides of methyl tauride, alkyl succinates and sulfosuccinates, monoesters of sulfosuccinate (especially saturated and unsaturated $C_{12}$–$C_{18}$ monoesters) diesters of sulfosuccinate (especially saturated and unsaturated $C_6$–$C_{14}$ diesters), N-acyl sarcosinates. Resin acids and hydrogenated resin acids are also suitable, such as rosin, hydrogenated rosin, and resin acids and hydrogenated resin acids present in or derived from tallow oil.

Especially suitable surfactants are the mid-chain branched surfactants. These include, mid-chain branched alkyl sulfates and mid-chain branched alkyl alkoxy sulfates. There are two types of especially preferred branched surfactants they are the sasol type and the shell type. The sasol type surfactants are a surfactant system comprising a branched surfactant mixture, said branched surfactant mixture comprising mid-chain branched and linear surfactant compounds, said linear compounds exceeding at least about 25% and less than about 70%, by weight of the branched surfactant mixture wherein the mid-chain branched surfactant compounds are of the formula:

$$A^b—B$$

wherein $A^b$ is a hydrophobic moiety having from about 10 to about 18 total carbons divided between a longest chain and at least one short chain, the longest chain being in the range of from about 9 to about 17 carbon atoms, there being one or more $C_1$–$C_3$ alkyl moieties branching from the longest chain, provided that at least one of the branching alkyl moieties is attached directly to a carbon of the longest linear carbon chain at a position within the range of position 3 carbon, counting from carbon #1 which is attached to the—B moiety, to position ω—2 carbon, wherein ω is the terminal carbon B is a hydrophilic moiety selected from the group consisting of $OSO_3M$, (EO/PO), (EO/PO)m$OSO_3M$ and mixtures thereof, wherein EO/PO are alkoxy moieties selected from the group consisting of ethoxy, propoxy, and mixtures thereof, wherein m is at least about 1 to about 30 and M is hydrogen or a salt forming cation provided that the average total number of carbon atoms in the $A^b$ moiety in the branched surfactant mixture is within the range of greater than about 11 to about 14.5.

The shell type surfactants surfactant system comprising a branched surfactant mixture, said branched surfactant mixture comprising mid-chain branched and linear surfactant compounds, said linear compounds less than about 25% by weight of the branched surfactant mixture wherein the mid-chain branched surfactant compounds are of the formula:

$$A^b—B$$

wherein $A^b$ is a hydrophobic moiety having from about 10 to about 18 total carbons divided between a longest chain and at least one short chain, the longest chain being in the range of from about 9 to about 17 carbon atoms, there being one or more $C_1$–$C_3$ alkyl moieties branching from the longest chain, provided that at least one of the branching alkyl moieties is attached directly to a carbon of the longest linear carbon chain at a position within the range of position 3 carbon, counting from carbon #1 which is attached to the—B moiety, to position ω—2 carbon, wherein ω is the terminal carbon B is a hydrophilic moiety selected from the group consisting of $OSO_3M$, (EO/PO), (EO/PO)m$OSO_3M$ and mixtures thereof, wherein EO/PO are alkoxy moieties selected from the group consisting of ethoxy, propoxy, and mixtures thereof, wherein m is at least about 1 to about 30 and M is hydrogen or a salt forming cation provided that the average total number of carbon atoms in the $A^b$ moiety in the branched surfactant mixture is within the range of greater than about 11 to about 14.5.

See U.S. patent applications Ser. Nos. 60/061,971 filed Oct. 14, 1997, Ser. No. 60/061,975 filed Oct. 14, 1997, 60/062,086 filed Oct. 14, 1997, Ser. No. 60/061,916 filed Oct. 14, 1997, Ser. No. 60/061,970 filed Oct. 14, 1997 and Ser. No. 60/062,407 filed Oct. 14, 1997. Other suitable mid-chain branched surfactants can be found in U.S. patent applications Ser. Nos. 60/031,845 and Ser. No. 60/031,916 all of which are incorporated herein by reference.

Anionic sulfate surfactants suitable for use herein include the linear and branched primary and secondary alkyl sulfates, alkyl ethoxysulfates, fatty oleoyl glycerol sulfates, alkyl phenol ethylene oxide ether sulfates, the $C_5$–$C_{17}$ acyl—N—($C_1$–$C_4$ alkyl) and —N—($C_1$–$C_2$ hydroxyalkyl) glucamine sulfates, and sulfates of alkylpolysaccharides such as the sulfates of alkylpolyglucoside (the nonionic nonsulfated compounds being described herein).

Alkyl sulfate surfactants are preferably selected from the linear and branched primary $C_{10}$–$C_{18}$ alkyl sulfates, more preferably the $C_{11}$–$C_{15}$ branched chain alkyl sulfates and the $C_{12}$–$C_{14}$ linear chain alkyl sulfates.

Alkyl ethoxysulfate surfactants are preferably selected from the group consisting of the $C_{10}$–$C_{18}$ alkyl sulfates which have been ethoxylated with from 0.5 to 20 moles of ethylene oxide per molecule. More preferably, the alkyl ethoxysulfate surfactant is a $C_{11}$–$C_{18}$, most preferably $C_{11}$–$C_{15}$ alkyl sulfate which has been ethoxylated with from 0.5 to 7, preferably from 1 to 5, moles of ethylene oxide per molecule.

A particularly preferred aspect of the invention employs mixtures of the preferred alkyl sulfate and alkyl ethoxysulfate surfactants. Such mixtures have been disclosed in PCT Patent Application No. WO 93/18124.

Anionic sulfonate surfactants suitable for use herein include the salts of $C_5$–$C_{20}$ linear or branched alkylbenzene sulfonates, alkyl ester sulfonates, $C_6$–$C_{22}$ primary or secondary alkane sulfonates, $C_6$–$C_{24}$ olefin sulfonates, sulfonated polycarboxylic acids, alkyl glycerol sulfonates, fatty acyl glycerol sulfonates, fatty oleyl glycerol sulfonates, and any mixtures thereof.

Suitable anionic carboxylate surfactants include the alkyl ethoxy carboxylates, the alkyl polyethoxy polycarboxylate surfactants and the soaps ('alkyl carboxyls'), especially certain secondary soaps as described herein.

Suitable alkyl ethoxy carboxylates include those with the formula $RO(CH_2CH_2O)_x\ CH_2COO^-M^+$ wherein R is a $C_6$ to $C_{18}$ alkyl group, x ranges from 0 to 10, and the ethoxylate distribution is such that, on a weight basis, the amount of material where x is 0 is less than 20% and M is a cation. Suitable alkyl polyethoxy polycarboxylate surfactants include those having the formula RO—($CHR_1$—$CHR_2$—O)—$R_3$ wherein R is a $C_6$ to $C_{18}$ alkyl group, x is from 1 to 25, $R_1$ and $R_2$ are selected from the group consisting of hydrogen, methyl acid radical, succinic acid radical, hydroxysuccinic acid radical, and mixtures thereof, and $R_3$ is selected from the group consisting of hydrogen, substituted or unsubstituted hydrocarbon having between 1 and 8 carbon atoms, and mixtures thereof.

Suitable soap surfactants include the secondary soap surfactants which contain a carboxyl unit connected to a secondary carbon. Preferred secondary soap surfactants for use herein are water-soluble members selected from the group consisting of the water-soluble salts of 2-methyl-1-undecanoic acid, 2-ethyl-1-decanoic acid, 2-propyl-1-nonanoic acid, 2-butyl-1-octanoic acid and 2-pentyl-1-heptanoic acid. Also suitable are branched soaps. Certain soaps may also be included as suds suppressors.

Other suitable anionic surfactants are the alkali metal sarcosinates of formula R—CON ($R^1$) $CH_2$ COOM, wherein R is a $C_5$–$C_{17}$ linear or branched alkyl or alkenyl group, $R^1$ is a $C_1$–$C_4$ alkyl group and M is an alkali metal ion. Preferred examples are the myristyl and oleoyl methyl sarcosinates in the form of their sodium salts.

Amphoteric Surfactant

Suitable amphoteric surfactants for use herein include the amine oxide surfactants and the alkyl amphocarboxylic acids.

Suitable amine oxides include those compounds having the formula $R^3(OR^4)_xN^0(R^5)_2$ wherein $R^3$ is selected from an alkyl, hydroxyalkyl, acylamidopropoyl and alkyl phenyl group, or mixtures thereof, containing from 8 to 26 carbon atoms; $R^4$ is an alkylene or hydroxyalkylene group containing from 2 to 3 carbon atoms, or mixtures thereof; x is from 0 to 5, preferably from 0 to 3; and each $R^5$ is an alkyl or hydroxyalkyl group containing from 1 to 3, or a polyethylene oxide group containing from 1 to 3 ethylene oxide groups. Preferred are $C_{10}$–$C_{18}$ alkyl dimethylamine oxide, and $C_{10\text{-}18}$ acylamido alkyl dimethylamine oxide.

A suitable example of an alkyl aphodicarboxylic acid is Miranol(TM) C2M Conc. manufactured by Miranol, Inc., Dayton, N.J.

Zwitterionic Surfactant

Zwitterionic surfactants can also be incorporated into the detergent compositions hereof. These surfactants can be broadly described as derivatives of secondary and tertiary amines, derivatives of heterocyclic secondary and tertiary amines, or derivatives of quaternary ammonium, quaternary phosphonium or tertiary sulfonium compounds. Betaine and sultaine surfactants are exemplary zwitterionic surfactants for use herein.

Suitable betaines are those compounds having the formula $R(R')_2N^+R^2COO^-$ wherein R is a $C_6$–$C_{18}$ hydrocarbyl group, each $R^1$ is typically $C_1$–$C_3$ alkyl, and $R^2$ is a $C_1$–$C_5$ hydrocarbyl group. Preferred betaines are $C_{12-18}$ dimethylarmnonio hexanoate and the $C_{10-18}$ acylamidopropane (or ethane) dimethyl (or diethyl) betaines. Complex betaine surfactants are also suitable for use herein.

Cationic Surfactants

Cationic ester surfactants used in this invention are preferably water dispersible compound having surfactant properties comprising at least one ester (i.e. —COO—) linkage and at least one cationically charged group. Other suitable cationic ester surfactants, including choline ester surfactants, have for example been disclosed in U.S. Pat. Nos. 4,228,042, 4,239,660 and 4,260,529.

Suitable cationic surfactants include the quaternary ammonium surfactants selected from mono $C_6$–$C_{16}$, preferably $C_6$–$C_{10}$ N-alkyl or alkenyl ammonium surfactants wherein the remaining N positions are substituted by methyl, hydroxyethyl or hydroxypropyl groups.

Deterrent Builders

The present invention may include an optional builder in the product composition. The level of detergent salt/builder can vary widely depending upon the end use of the composition and its desired physical form. When present, the compositions will typically, comprise at least about 1% detergent builder and more typically from about 10% to about 80%, even more typically from about 15% to about 50% by weight, of the detergent builder. Lower or higher levels, however, are not meant to be excluded.

Inorganic or P-containing detergent builders include, but are not limited to, the alkali metal, ammonium and alkanolammonium salts of polyphosphates (exemplified by the tripolyphosphates, pyrophosphates, and glassy polymeric meta-phosphates), phosphonates, phytic acid, silicates, carbonates (including bicarbonates and sesquicarbonates), sulphates, and aluminosilicates. However, non-phosphate salts are required in some locales. Importantly, the compositions herein function surprisingly well even in the presence of the so-called "weak" builders (as compared with phosphates) such as citrate, or in the so-called "underbuilt" situation that may occur with zeolite or layered silicate builders.

Examples of silicate builders are the alkali metal silicates, particularly those having a $SiO_2$:$Na_2O$ ratio in the range 1.6:1 to 3.2:1 and layered silicates, such as the layered sodium silicates described in U.S. Pat. No. 4,664,839, issued May 12, 1987 to H. P. Rieck. NaSKS-6 is the trademark for a crystalline layered silicate marketed by Hoechst (commonly abbreviated herein as "SKS-6"). Unlike zeolite builders, the Na SKS-6 silicate builder does not contain aluminum. NaSKS-6 has the delta-$Na_2SiO_5$ morphology form of layered silicate. It can be prepared by methods such as those described in German DE-A-3,417,649 and DE-A-3,742,043. SKS-6 is a highly preferred layered silicate for use herein, but other such layered silicates, such as those having the general formula $NaMSi_xO_{2x+1}\cdot yH_2O$ wherein M is sodium or hydrogen, x is a number from 1.9 to 4, preferably 2, and y is a number from 0 to 20, preferably 0 can be used herein. Various other layered silicates from Hoechst include NaSKS-5, NaSKS-7 and NaSKS-1 1, as the alpha, beta and gamma forms. As noted above, the delta-$Na_2SiO_5$ (NaSKS-6 form) is most preferred for use herein. Other silicates may also be useful such as for example magnesium silicate, which can serve as a crispening agent in granular formulations, as a stabilizing agent for oxygen bleaches, and as a component of suds control systems.

Examples of carbonate salts as builders are the alkaline earth and alkali metal carbonates as disclosed in German Patent Application No. 2,321,001 published on Nov. 15, 1973.

Aluminosilicate builders may also be added to the present invention as a detergent salt. Aluminosilicate builders are of great importance in most currently marketed heavy duty granular detergent compositions. Aluminosilicate builders include those having the empirical formula:

$$M_z[(SiO_2)_w(AlO_2)_y].\ xH_2O$$

wherein z, w and y are integers of at least 6, the molar ratios of z to y and z to w are in the range from 1.0 to about 0.5, and x is an integer from about 15 to about 264.

Useful aluminosilicate ion exchange materials are commercially available. These aluminosilicates can be crystalline or amorphous in structure and can be naturally-occurring aluminosilicates or synthetically derived. A method for producing aluminosilicate ion exchange materials is disclosed in U.S. Pat. No. 3,985,669, Krummel, et al, issued Oct. 12, 1976. Preferred synthetic crystalline aluminosilicate ion exchange materials useful herein are available under the designations Zeolite A, Zeolite P (B), Zeolite MAP and Zeolite X. In an especially preferred embodiment, the crystalline aluminosilicate ion exchange material has the formula:

$$Na_{12}[(AlO_2)_{12}(SiO_2)_{12}].xH_2O$$

wherein x is from about 20 to about 30, especially about 27. This material is known as Zeolite A. Dehydrated zeolites (x=0–10) may also be used herein. Preferably, the aluminosilicate has a particle size of about 0.1–10 microns in diameter.

Organic detergent builders suitable for the purposes of the present invention include, but are not restricted to, a wide variety of polycarboxylate compounds. As used herein, "polycarboxylate" refers to compounds having a plurality of carboxylate groups, preferably at least 3 carboxylates. Polycarboxylate builder can generally be added to the composition in acid form, but can also be added in the form of a neutralized salt. When utilized in salt form, alkali metals, such as sodium, potassium, and lithium, or alkanolammonium salts are preferred.

Included among the polycarboxylate builders are a variety of categories of useful materials. One important category of polyearboxylate builders encompasses the ether polycarboxylates, including oxydisuccinate, as disclosed in Berg, U.S. Pat. No. 3,128,287, issued Apr. 7, 1964, and Lamberti et al, U.S. Pat. No. 3,635,830, issued Jan. 18, 1972. See also "TMS/TDS" builders of U.S. Pat. No. 4,663,071, issued to Bush et al, on May 5, 1987. Suitable ether polycarboxylates also include cyclic compounds, particularly alicyclic compounds, such as those described in U.S. Pat. Nos. 3,923,679; 3,835,163; 4,158,635; 4,120,874 and 4,102,903.

Other useful detergency builders include the ether hydroxypolycarboxylates, copolymers of maleic anhydride with ethylene or vinyl methyl ether, 1,3,5-trihydroxy benzene-2,4,6-trisulphonic acid, and carboxymethyloxysuccinic acid, the various alkali metal, ammonium and substituted ammonium salts of polyacetic acids such as ethylenediamine tetraacetic acid and nitrilotriacetic acid, as well as polycarboxylates such as mellitic acid, succinic acid, oxydisuccinic acid, polymaleic acid, benzene 1,3,5-tricarboxylic acid, carboxymethyloxysuccinic acid, and soluble salts thereof.

Citrate builders, e.g., citric acid and soluble salts thereof (particularly sodium salt), are polycarboxylate builders of particular importance. Oxydisuccinates are also especially useful in such compositions and combinations.

Also suitable in the detergent compositions of the present invention are the 3,3-dicarboxy-4-oxa-1,6-hexanedioates and the related compounds disclosed in U.S. Pat. No. 4,566,984, Bush, issued Jan. 28, 1986. Useful succinic acid builders include the $C_5$–$C_{20}$ alkyl and alkenyl succinic acids and salts thereof. A particularly preferred compound of this type is dodecenylsuccinic acid. Specific examples of succinate builders include: laurylsuccinate, myristylsuccinate, palmitylsuccinate, 2-dodecenylsuccinate (preferred), 2-pentadecenylsuccinate, and the like. Laurylsuccinates are the preferred builders of this group, and are described in European Patent Application 86200690.5/0,200,263, published Nov. 5, 1986.

Other suitable polycarboxylates are disclosed in U.S. Pat. No. 4,144,226, Crutchfield et al, issued Mar. 13, 1979 and in U.S. Pat. No. 3,308,067, Diehl, issued Mar. 7, 1967. See also Diehl U.S. Pat. No. 3,723,322.

Fatty acids, e.g., $C_{12}$–$C_{18}$ monocarboxylic acids, can also be incorporated into the compositions alone, or in combination with the aforesaid builders, especially citrate and/or the succinate builders, to provide additional builder activity. Such use of fatty acids will generally result in a diminution of sudsing, which should be taken into account by the formulator.

Bleaching Agents

Bleaching agents according to the present invention may include both chlorine and oxygen bleaching systems. Hydrogen peroxide sources are described in detail in the herein incorporated Kirk Othmer's Encyclopedia of Chemical Technology, 4th Ed (1992, John Wiley & Sons), Vol. 4, pp. 271–300"Bleaching Agents (Survey)", and include the various forms of sodium perborate and sodium percarbonate, including various coated and modified forms. An "effective amount" of a source of hydrogen peroxide is any amount capable of measurably improving stain removal (especially of tea stains) from soiled dishware compared to a hydrogen peroxide source-free composition when the soiled dishware is washed by the consumer in a domestic automatic dishwasher in the presence of alkali.

More generally a source of hydrogen peroxide herein is any convenient compound or mixture which under consumer use conditions provides an effective amount of hydrogen peroxide. Levels may vary widely and are usually in the range from about 0.1% to about 70%, more typically from about 0.5% to about 30%, by weight of the compositions herein.

The preferred source of hydrogen peroxide used herein can be any convenient source, including hydrogen peroxide itself. For example, perborate, e.g., sodium perborate (any hydrate but preferably the mono- or tetra-hydrate), sodium carbonate peroxyhydrate or equivalent percarbonate salts, sodium pyrophosphate peroxyhydrate, urea peroxyhydrate, or sodium peroxide can be used herein. Also useful are sources of available oxygen such as persulfate bleach (e.g., OXONE, manufactured by DuPont). Sodium perborate monohydrate and sodium percarbonate are particularly preferred. Mixtures of any convenient hydrogen peroxide sources can also be used.

A preferred percarbonate bleach comprises dry particles having an average particle size in the range from about 500 micrometers to about 1,000 micrometers, not more than about 10% by weight of said particles being smaller than about 200 micrometers and not more than about 10% by weight of said particles being larger than about 1,250 micrometers. Optionally, the percarbonate can be coated with a silicate, borate or water-soluble surfactants. Percarbonate is available from various commercial sources such as FMC, Solvay and Tokai Denka.

Compositions of the present invention may also comprise as the bleaching agent a chlorine-type bleaching material. Such agents are well known in the art, and include for example sodium dichloroisocyanurate ("NaDCC"), or sodium hypochlorite (NaOCl). When chlorine bleaching agents are present it is critical that they be separated from any enzymes or any detergent active agents which are bleach sensitive. Furthermore, when a chlorine bleach is used, it is important that the bleach be either removed or neutralized by a bleach scavenger, before any enzymes or any detergent active agents which are bleach sensitive are released in to the washing solution.

(a) Bleach Activators

Preferably, the peroxygen bleach component in the composition is formulated with an activator (peracid precursor). The activator is present at levels of from about 0.01% to about 15%, preferably from about 0.5% to about 10%, more preferably from about 1% to about 8%, by weight of the composition. Preferred activators are selected from the group consisting of tetraacetyl ethylene diamine (TAED), benzoylcaprolactam (BzCL), 4-nitrobenzoylcaprolactam, 3-chlorobenzoyl-caprolactam, benzoyloxybenzenesulphonate (BOBS), nonanoyloxybenzene-sulphonate (NOBS), phenyl benzoate (PhBz), decanoyloxybenzenesulphonate ($C_{10}$-OBS), benzoylvalerolactam (BZVL), octanoyloxybenzenesulphonate ($C_8$-OBS), perhydrolyzable esters and mixtures thereof, most preferably benzoylcaprolactam and benzoylvalerolactam. Particularly preferred bleach activators in the pH range from about 8 to about 9.5 are those selected having an OBS or VL leaving group.

Preferred bleach activators are those described in U.S. Pat. No. 5,130,045, Mitchell et al, and U.S. Pat. No. 4,412,934, Chung et al, and copending patent applications U.S. Ser. Nos. 08/064,624, 08/064,623, 08/064,621, 08/064,562, 08/064,564, all abandoned and copending application to M. Bums, A. D. Willey, R. T. Hartshorn, C. K. Ghosh, entitled "Bleaching Compounds Comprising Peroxyacid Activators Used With Enzymes" and having U.S. Ser. No. 08/133,691 (P&G Case 4890R) now abandoned, all of which are incorporated herein by reference.

The mole ratio of peroxygen bleaching compound (as AvO) to bleach activator in the present invention generally ranges from at least 1:1, preferably from about 20:1 to about 1:1, more preferably from about 10:1 to about 3:1.

Quaternary substituted bleach activators may also be included. The present detergent compositions preferably comprise a quaternary substituted bleach activator (QSBA) or a quaternary substituted peracid (QSP); more preferably, the former. Preferred QSBA structures are further described in copending U.S. Pat. Nos. 5,460,747, 5,584,888 and 5,578,136, incorporated herein by reference.

(b) Organic Peroxides especially Diacyl Peroxides

These are extensively illustrated in Kirk Othmer, Encyclopedia of Chemical Technology, Vol. 17, John Wiley and Sons, 1982 at pages 27–90 and especially at pages 63–72, all incorporated herein by reference. If a diacyl peroxide is used, it will preferably be one which exerts minimal adverse impact on spotting/filming. Preferred is dibenzoyl peroxide.

(c) Metal-containing Bleach Catalysts

The present invention compositions and methods can utilize metal-containing bleach catalysts that are effective for use in ADD compositions. Preferred are manganese and cobalt-containing bleach catalysts.

One type of metal-containing bleach catalyst is a catalyst system comprising a transition metal cation of defined bleach catalytic activity, such as copper, iron, titanium, ruthenium tungsten, molybdenum, or manganese cations, an auxiliary metal cation having little or no bleach catalytic activity, such as zinc or aluminum cations, and a sequestrate having defined stability constants for the catalytic and auxiliary metal cations, particularly ethylenediaminetetraacetic acid, ethylenediaminetetra (methylenephosphonic acid) and water-soluble salts thereof. Such catalysts are disclosed in U.S. Pat. No. 4,430,243.

Other types of bleach catalysts include the manganese-based complexes disclosed in U.S. Pat. No. 5,246,621 and U.S. Pat. No. 5,244,594. Preferred examples of theses catalysts include $Mn^{IV}2(u\text{-}O)_3$(1,4,7-trimethyl-1,4,7-triazacyclononane) $_2$-$(PF_6)_2$ ("MnTACN"), $Mn^{III}{}_2(u\text{-}O)_1(u\text{-}OAc)_2$(1,4,7-trimethyl-1,4,7-triazacyclono-nane)$_2$-$(ClO_4)_2$, $Mn^{IV}{}_4(u\text{-}O)_6$(1,4,7-triazacyclonane)$_2$-$(ClO_4)_2$, $Mn^{III}Mn^{IV}{}_4$) u-O)$_1$) (u-OAc)$_2$(1,4,7-trimethyl-1,4,7-triazacyclononane) 2-$(ClO_4)_3$, and mixtures thereof. See also European patent application publication no. 549,272. Other ligands suitable for use herein include 1,5,9-trimethyl-1,5,9-triazacyclododecane, 2-methyl-1,4,7-triazacyclononane, 2-methyl-1,4,7-triazacyclononane, and mixtures thereof.

The bleach catalysts useful in automatic dishwashing compositions and concentrated powder detergent compositions may also be selected as appropriate for the present invention. For examples of suitable bleach catalysts see U.S. Pat. No. 4,246,612 and U.S. Pat. No. 5,227,084.

Other bleach catalysts are described, for example, in European patent application, publication no. 408,131 (cobalt complex catalysts), European patent applications, publication nos. 384,503, and 306,089 (metallo-porphyrin catalysts), U.S. Pat. No. 4,728,455 (manganese/multidentate ligand catalyst), U.S. Pat. No. 4,711,748 and European patent application, publication no. 224,952, (absorbed manganese on aluminosilicate catalyst), U.S. Pat. No. 4,601,845 (aluminosilicate support with manganese and zinc or magnesium salt), U.S. Pat. No. 4,626,373 (manganese/ligand catalyst), U.S. Pat. No. 4,119,557 (ferric complex catalyst), German Pat. specification 2,054,019 (cobalt chelant catalyst) Canadian 866,191 (transition metal-containing salts), U.S. Pat. No. 4,430,243 (chelants with manganese cations and non-catalytic metal cations), and U.S. Pat. No. 4,728,455 (manganese gluconate catalysts).

Preferred are cobalt catalysts which have the formula:

$$[Co(NH_3)_n(M')_m]Y_y$$

wherein n is an integer from 3 to 5 (preferably 4 or 5; most preferably 5); M' is a labile coordinating moiety, preferably selected from the group consisting of chlorine, bromine, hydroxide, water, and (when m is greater than 1) combinations thereof; m is an integer from 1 to 3 (preferably 1 or 2; most preferably 1); m+n=6; and Y is an appropriately selected counteranion present in a number y, which is an integer from 1 to 3 (preferably 2 to 3; most preferably 2 when Y is a −1 charged anion), to obtain a charge-balanced salt.

The preferred cobalt catalyst of this type useful herein are cobalt pentaamine chloride salts having the formula $[Co(NH_3)_5Cl]Y_y$, and especially $[Co(NH_3)_5Cl]Cl_2$.

More preferred are the present invention compositions which utilize cobalt (III) bleach catalysts having the formula:

$$[Co(NH3)_n(M)_m(B)_b]T_y$$

wherein cobalt is in the +3 oxidation state; n is 4 or 5 (preferably 5); M is one or more ligands coordinated to the cobalt by one site; m is 0, 1 or 2 (preferably 1); B is a ligand coordinated to the cobalt by two sites; b is 0 or 1 (preferably 0), and when b=0, then m+n=6, and when b=1, then m=0 and n=4; and T is one or more appropriately selected counteranions present in a number y, where y is an integer to obtain a charge-balanced salt (preferably y is 1 to 3; most preferably 2 when T is a −1 charged anion); and wherein further said catalyst has a base hydrolysis rate constant of less than 0.23 $M^{-1}$ $s^{-1}$ (25° C).

Preferred T are selected from the group consisting of chloride, iodide, $I_3^-$, formate, nitrate, nitrite, sulfate, sulfite, citrate, acetate, carbonate, bromide, $PF_6^-$, $BF_4^-$, $B(Ph)_4^-$, phosphate, phosphite, silicate, tosylate, methanesulfonate, and combinations thereof. Optionally, T can be protonated if more than one anionic group exists in T, e.g., $HPO_4^{2-}$, $HCO_3^-$, $H_2PO_4^-$, etc. Further, T may be selected from the group consisting of non-traditional inorganic anions such as anionic surfactants (e.g., linear alkylbenzene sulfonates (LAS), alkyl sulfates (AS), alkylethoxysulfonates (ABS), etc.) and/or anionic polymers (e.g., polyacrylates, polymethacrylates, etc.).

The M moieties include, but are not limited to, for example, $F^-$, $SO_4^{-2}$, $NCS^-$, $SCN^-$, $S_2O_3^{-2}$, $NH_3$, $PO_4^{3-}$, and carboxylates (which preferably are mono-carboxylates, but more than one carboxylate may be present in the moiety as long as the binding to the cobalt is by only one carboxylate per moiety, in which case the other carboxylate in the M moiety may be protonated or in its salt form). Optionally, M can be protonated if more than one anionic group exists in M (e.g., $HPO_4^{2-}$, $HCO_3^-$, $H_2PO_4^-$, $HOC(O)CH_2C(O)O$—, etc.) Preferred M moieties are substituted and unsubstituted $C_1$–$C_{30}$ carboxylic acids having the formulas:

$$RC(O)O—$$

wherein R is preferably selected from the group consisting of hydrogen and $C_1$–$C_{30}$ (preferably $C_1$–$C_{18}$) unsubstituted and substituted alkyl, $C_6$–$C_{30}$ (preferably $C_6$–$C_{18}$) unsubstituted and substituted aryl, and $C_3$–$C_{30}$ (preferably $C_5$–$C_{18}$) unsubstituted and substituted heteroaryl, wherein substituents are selected from the group consisting of —$NR'_3$, —$NR'_4$+, —C(O)OR', —OR', —$C(O)NR'_2$, wherein R' is selected from the group consisting of hydrogen and $C_1$–$C_6$ moieties. Such substituted R therefore include the moieties —$(CH_2)_nOH$ and —$(CH_2)_nNR'_4$+, wherein n is an integer from 1 to about 16, preferably from about 2 to about 10, and most preferably from about 2 to about 5.

Most preferred M are carboxylic acids having the formula above wherein R is selected from the group consisting of hydrogen, methyl, ethyl, propyl, straight or branched $C_4$–$C_{12}$ alkyl, and benzyl. Most preferred R is methyl. Preferred carboxylic acid M moieties include formic, benzoic, octanoic, nonanoic, decanoic, dodecanoic, malonic, maleic, succinic, adipic, phthalic, 2-ethylhexanoic, naphthenoic, oleic, palmitic, triflate, tartrate, stearic, butyric, citric, acrylic, aspartic, furmaric, lauric, linoleic, lactic, malic, and especially acetic acid.

The B moieties include carbonate, di- and higher carboxylates (e.g., oxalate, malonate, malic, succinate, maleate), picolinic acid, and alpha and beta amino acids (e.g., glycine, alanine, beta-alanine, phenylalanine).

Cobalt bleach catalysts useful herein are known, being described for example along with their base hydrolysis rates, in M. L. Tobe, "Base Hydrolysis of Transition-Metal Complexes", *Adv. Inorg. Bioinorg. Mech.*, (1983), 2, pages 1–94. For example, Table 1 at page 17, provides the base hydrolysis rates (designated therein as $k_{OH}$) for cobalt pentaamine catalysts complexed with oxalate ($k_{OH}$=2.5×$10^{-4}$ $M^{-1}$ $s^{-1}$ (25° C.)), $NCS^-$ ($k_{OH}$=5.0×$10^{-4}$ $M^{-1}$ $s^{-1}$ (25° C.)), 5.8×$10^{-4}$ $M^{-1}$ $s^{-1}$ (25° C.)), and acetate ($k_{OH}$=9.6×$10^{-4}$ $M^{-1}$ $s^{-1}$ (25° C. The most preferred cobalt catalyst useful herein are cobalt pentaamine acetate salts having the formula $[Co(NH_3)_5OAc]T_y$, wherein OAc represents an acetate moiety, and especially cobalt pentaamine acetate chloride, $[Co(NH_3)_5OAc]Cl_2$; as well as $[Co(NH_3)_5OAc](OAc)_2$; $[Co(NH_3)_5OAc](PF_6)_2$; $[Co(NH_3)_5OAc](SO_4)$; $[Co(NH_3)_5OAc](BF_4)_2$; and $[Co(NH_3)_5OAc](NO_3)_2$.

Cobalt catalysts according to the present invention made be produced according to the synthetic routes disclosed in U.S. Pat. Nos. 5,559,261, 5,581,005, and 5,597,936, the disclosures of which are herein incorporated by reference.

These catalysts may be co-processed with adjunct materials so as to reduce the color impact if desired for the aesthetics of the product, or to be included in enzyme-containing particles as exemplified hereinafter, or the compositions may be manufactured to contain catalyst "speckles".

As a practical matter, and not by way of limitation, the cleaning compositions and cleaning processes herein can be adjusted to provide on the order of at least one part per hundred million of the active bleach catalyst species in the aqueous washing medium, and will preferably provide from about 0.01 ppm to about 25 ppm, more preferably from about 0.05 ppm to about 10 ppm, and most preferably from about 0.1 ppm to about 5 ppm, of the bleach catalyst species in the wash liquor. In order to obtain such levels in the wash liquor of an automatic dishwashing process, typical automatic dishwashing compositions herein will comprise from about 0.0005% to about 0.2%, more preferably from about 0.004% to about 0.08%, of bleach catalyst by weight of the cleaning compositions.

Controlled Rate of Release

The detergent tablet may be provided with a way for controlling the rate of release of bleaching agent, particularly oxygen bleach to the wash solution.

The controlling of the rate of release of the bleach may provide for controlled release of peroxide species to the wash solution. This could, for example, include controlling the release of any inorganic perhydrate salt, acting as a hydrogen peroxide source, to the wash solution.

Suitable ways of controlled release of the bleaching agent can include confining the bleach to the core, first encapsulating layer or the second encapsulating layer.

Another way for controlling the rate of release of bleach may be by coating the bleach with a coating designed to provide the controlled release. The coating may therefore, for example, comprise a poorly water soluble material, or be a coating of sufficient thickness that the kinetics of dissolution of the thick coating provide the controlled rate of release.

The coating material may be applied using various methods. Any coating material is typically present at a weight ratio of coating material to bleach of from about 1:99 to about 1:2, preferably from about 1:49 to about 1:9.

Suitable coating materials include triglycerides (e.g. partially) hydrogenated vegetable oil, soy bean oil, cotton seed oil) mono or diglycerides, microcrystalline waxes, gelatin, cellulose, fatty acids and any mixtures thereof.

Other suitable coating materials can comprise the alkali and alkaline earth metal sulphates, silicates and carbonates, including calcium carbonate and silicas.

A preferred coating material, particularly for an inorganic perhydrate salt bleach source, comprises sodium silicate of $SiO_2$:$Na_2O$ ratio from 1.8:1 to 3.0:1, preferably 1.8:1 to 2.4:1, and/or sodium metasilicate, preferably applied at a level of from 2% to 10%, (normally from 3% to 5%) of $SiO_2$ by weight of the inorganic perhydrate salt. Magnesium silicate can also be included in the coating.

Any inorganic salt coating materials may be combined with organic binder materials to provide composite inorganic salt/organic binder coatings. Suitable binders include the $C_{10}$–$C_{20}$ alcohol ethoxylates containing from 5–100 moles of ethylene oxide per mole of alcohol and more preferably the $C_{15}$–$C_{20}$ primary alcohol ethoxylates containing from 20–100 moles of ethylene oxide per mole of alcohol.

Other preferred binders include certain polymeric materials. Polyvinylpyrrolidones with an average molecular weight of from 12,000 to 00,000 and polyethylene glycols (PEG) with an average molecular weight of from 600 to 5×$10^6$ preferably 1000 to 400,000 most preferably 1000 to 10,000 are examples of such polymeric materials. Copolymers of maleic anhydride with ethylene, methylvinyl ether or methacrylic acid, the maleic anhydride constituting at least 20 mole percent of the polymer are further examples of polymeric materials useful as binder agents. These polymeric materials may be used as such or in combination with solvents such as water, propylene glycol and the above mentioned $C_{10}$–$C_{20}$ alcohol ethoxylates containing from 5–100 moles of ethylene oxide per mole. Further examples of binders include the $C_{10}$–$C_{20}$ mono- and diglycerol ethers and also the $C_{10}$–$C_{20}$ fatty acids.

Cellulose derivatives such as methylcellulose, carboxymethylcellulose and hydroxyethylcellulose, and homo- or co-polymeric polycarboxylic acids or their salts are other examples of binders suitable for use herein.

One method for applying the coating material involves agglomeration. Preferred agglomeration processes include the use of any of the organic binder materials described hereinabove. Any conventional agglomerator/mixer may be used including, but not limited to pan, rotary drum and vertical blender types. Molten coating compositions may also be applied either by being poured onto, or spray atomized onto a moving bed of bleaching agent.

Other ways of providing the required controlled release include altering the physical characteristics of the bleach to control its solubility and rate of release. Suitable ways could include compression, mechanical injection, manual injection, and adjustment of the solubility of the bleach compound by selection of particle size of any particulate component.

Whilst the choice of particle size will depend both on the composition of the particulate component, and the desire to meet the desired controlled release kinetics, it is desirable that the particle size should be more than 500 micrometers, preferably having an average particle diameter of from 800 to 1200 micrometers.

Additional ways for providing controlled release include the suitable choice of any other components of the detergent composition matrix such that when the composition is introduced to the wash solution the ionic strength environment therein provided enables the required controlled release kinetics to be achieved.

Bleach Scavengers

Chlorine bleach-containing compositions herein may comprise from about 0.001% to about 10%, preferably from about 0.005% to about 8%, most preferably from about 0.01% to about 6%, by weight of a bleach scavenger. The bleach scavenger can be any bleach scavenger which is compatible with the detersive enzyme. Suitable bleach scavengers include perborate, reducing agents, such as thiosulfate, and ammonium salts such as ammonium sulfate, with perborate being preferred.

Detersive Enzymes

The compositions of the present invention may also include the presence of at least one detersive enzyme. "Detersive enzymee", as used herein, means any enzyme having a cleaning, stain removing or otherwise beneficial effect in a composition. Preferred detersive enzymes are hydrolases such as proteases, amylases and lipases. Highly preferred for automatic dishwashing are amylases and/or proteases, including both current commercially available types and improved types which, though more bleach compatible, have a remaining degree of bleach deactivation susceptibility.

In general, as noted, preferred compositions herein comprise one or more detersive enzymes. If only one enzyme is used, it is preferably an amyolytic enzyme when the composition is for automatic dishwashing use. Highly preferred for automatic dishwashing is a mixture of proteolytic enzymes and amyloytic enzymes. More generally, the enzymes to be incorporated include proteases, amylases, lipases, cellulases, and peroxidases, as well as mixtures thereof. Other types of enzymes may also be included. They may be of any suitable origin, such as vegetable, animal, bacterial, fungal and yeast origin. However, their choice is governed by several factors such as pH-activity and/or stability optima, thermostability, stability versus active detergents, builders, etc. In this respect bacterial or fungal enzymes are preferred, such as bacterial amylases and proteases, and fingal cellulases.

Enzymes are normally incorporated in the instant detergent compositions at levels sufficient to provide a "cleaning-effective amount". The term "cleaning-effective amount" refers to any amount capable of producing a cleaning, stain removal or soil removal effect on substrates such as fabrics, dishware and the like. Since enzymes are catalytic materials, such amounts may be very small. In practical terms for current commercial preparations, typical amounts are up to about 5 mg by weight, more typically about 0.01 mg to about 3 mg, of active enzyme per grain of the composition. Stated otherwise, the compositions herein will typically comprise from about 0.001% to about 6%, preferably 0.01%–1% by weight of a commercial enzyme preparation. Protease enzymes are usually present in such commercial preparations at levels sufficient to provide from 0.005 to 0.1 Anson units (AU) of activity per gram of composition. For automatic dishwashing purposes, it may be desirable to increase the active enzyme content of the commercial preparations, in order to minimize the total amount of non-catalytically active materials delivered and thereby improve spotting/filming results.

Suitable examples of proteases are the subtilisins which are obtained from particular strains of B. subtilis and B. licheniformis. Another suitable protease is obtained from a strain of Bacillus, having maximum activity throughout the pH range of 8–12, developed and sold by Novo Industries A/S as ESPERASE®. The preparation of this enzyme and analogous enzymes is described in British Patent Specification No. 1,243,784 of Novo. Proteolytic enzymes suitable for removing protein-based stains that are commercially available include those sold under the tradenames ALCALASE® and SAVINASE® by Novo Industries A/S (Denmark) and MAXATASE® by International Bio-Synthetics, Inc. (The Netherlands) and PURAFECT®, by GCI. Other proteases include Protease A (see European Patent Application 130,756, published Jan. 9, 1985) and Protease B (see European Patent Application Serial No. 87303761.8, filed Apr. 28, 1987 now EP 0,251,446, and European Patent Application 130,756, Bott et al, published Jan. 9, 1985).

An especially preferred protease, referred to as "Protease D" is a carbonyl hydrolase variant having an amino acid sequence not found in nature, which is derived from a precursor carbonyl hydrolase by substituting a different amino acid for a plurality of amino acid residues at a position in said carbonyl hydrolase equivalent to position +76, preferably also in combination with one or more amino acid residue positions equivalent to those selected from the group consisting of +99, +101, +103, +104, +107, +123, +27, +105, +109, +126, +12 +195, +197, +204, +206, +210, +216, +217, +218, +222, +260, +265, and/or +274 according to the numbering of Bacillus amyloliquefaciens subtilisin, as described in WO 95/10615 published Apr. 20, 1995 by Genencor International.

Other preferred protease enzymes include protease enzymes which are a carbonyl hydrolase variant having an amino acid sequence not found in nature, which is derived by replacement of a plurality of amino acid residues of a precursor carbonyl hydrolase with different amino acids, wherein said plurality of amino acid residues replaced in the precursor enzyme correspond to position +210 in combination with one or more of the following residues: +33, +62, +67, +76, +100, +101, +103, +104, +107, +128, +129, +130, +132, +135, +156, +158, +164, +166, +167, +170, +209, +215, +217, +218 and +222, where the numbered positions correspond to naturally-occurring subtilisin from Bacillus amyloliquefaciens or to equivalent amino acid residues in other carbonyl hydrolases or subtilisins (such as Bacillus lentus subtilisin). Preferred enzymes according include those having position changes +210, +76, +103, +104, +156, and +166.

Useful proteases are also described in PCT publications: WO 95/30010 published Nov. 9, 1995 by The Procter & Gamble Company; WO 95/30011 published Nov. 9, 1995 by The Procter & Gamble Company; WO 95/29979 published Nov. 9, 1995 by The Procter & Gamble Company.

Amylases suitable herein include, for example, (α-amylases described in British Patent Specification No. 1,296,839 (Novo), RAPIDASE™, International Bio-Synthetics, Inc. ENDOLASE®, Novo Industries and TERMAMYL®, Novo Industries.

Preferred amylases herein have the commonalty of being derived using site-directed mutagenesis from one or more of the Baccillus amylases, especially the Bacillus alpha-amylases, regardless of whether one, two or multiple amylase strains are the immediate precursors.

As noted, "oxidative stability-enhanced" amylases are preferred for use herein despite the fact that the invention makes them "optional but preferred" materials rather than essential. Such amylases are non-limitingly illustrated by the following:

(a) An amylase according to the hereinbefore incorporated WO/94/02597, Novo Nordisk A/S, published Feb. 3, 1994, as further illustrated by a mutant in which substitution is made, using alanine or threonine (preferably threonine), of the methionine residue located in position 197 of the B.licheniformis alpha-amylase, known as TERMAMYL®, or the homologous position variation of a similar parent amylase, such as *B. amyloliquefaciens, B.subtilis, or B.stearothermophilus;*

(b) Stability-enhanced amylases as described by Genencor International in a paper entitled "Oxidatively Resistant alpha-Amylases" presented at the 207th American Chemical Society National Meeting, Mar. 13–17 1994, by C. Mitchinson. Therein it was noted that bleaches in automatic dishwashing detergents inactivate alpha-amylases but that improved oxidative stability amylases have been made by Genencor from *B.licheniformis* NCIB8061. Methionine (Met) was identified as the most likely residue to be modified. Met was substituted, one at a time, in positions 8,15,197,256,304,366 and 438 leading to specific mutants, particularly important being M197L and M197T with the M197T variant being the most stable expressed variant. Stability was measured in CASCADE® and SUNLIGHT®;

(c) Also preferred herein are amylase variants having additional modification in the immediate parent available from Novo Nordisk A/S and are those referred to by the supplier under the tradename DURMAMYL®;

(d) Particularly preferred are amylase variants as disclosed in WO 95/26397 and in the co-pending application to Novo Nordisk PCT/DK96/00056 now WO 96/23873 and characterized by having a specific activity at least 25% higher than the specific activity of Termamyl® at a temperature range of 25° C. to 55° C. and at a pH value in the range of 8 to 10, measured by the Phadebas®α-amylase activity assay and is obtained from an alkalophilic Bacillus species (such as. the strains NCIB 12289, NCIB 12512, NCIB 12513 and DSM 935) comprising the following amino acid sequence in the N-terminal: His-His-Asn-Gly-Thr-Asn-Gly-Thr-Met-Met-Gln-Tyr-Phe-Glu-Trp-Tyr-Leu-Pro-Asn-Asp Cellulases usable in, but not preferred, for the present invention include both bacterial or fungal cellulases. Typically, they will have a pH optimum of between 5 and 9.5. Suitable cellulases are disclosed in U.S. Pat. No. 4,435,307, Barbesgoard et al, issued Mar. 6, 1984, which discloses fungal cellulase produced from Humicola insolens and Humicola strain DSM1800 or a cellulase 212-producing fungus belonging to the genus Aeromonas, and cellulase extracted from the hepatopancreas of a marine mollusk (Dolabella Auricula Solander). Suitable cellulases are also disclosed in GB-A-2.075.028; GB-A-2.095.275 and DE-OS-2.247.832. CAREZYME® (Novo) is especially useful.

Suitable lipase enzymes for detergent use include those produced by microorganisms of the Pseudomonas group, such as Pseudomonas stutzeri ATCC 19.154, as disclosed in British Patent 1,372,034. See also lipases in Japanese Patent Application 53,20487, laid open to public inspection on Feb. 24, 1978. This lipase is available from Amano Pharmaceutical Co. Ltd., Nagoya, Japan, under the trade name Lipase P "Amano," hereinafter referred to as "Amano-P." Other commercial lipases include Amano-CES, lipases ex Chromobacter viscosum, e.g. Chromobacter viscosum var. lipolyticum NRRLB 3673, commercially available from Toyo Jozo Co., Tagata, Japan; and further Chromobacter viscosum lipases from U.S. Biochemical Corp., U.S.A. and Disoynth Co., The Netherlands, and lipases ex Pseudomonas gladioli. The LIPOLASE® enzyme derived from Humicola lanuginosa and commercially available from Novo (see also EPO 341,947) is a preferred lipase for use herein. Another preferred lipase enzyme is the D96L variant of the native Humicola lanuginosa lipase, as described in WO 92/05249 and Research Disclosure No. 35944, Mar. 10, 1994, both published by Novo. In general, lipolytic enzymes are less preferred than amylases and/or proteases for automatic dishwashing embodiments of the present invention.

Peroxidase enzymes can be used in combination with oxygen sources, e.g., percarbonate, perborate, persulfate, hydrogen peroxide, etc. They are typically used for "solution bleaching," i.e. to prevent transfer of dyes or pigments removed from substrates during wash operations to other substrates in the wash solution. Peroxidase enzymes are known in the art, and include, for example, horseradish peroxidase, ligninase, and haloperoxidase such as chloro- and bromo-peroxidase. Peroxidase-containing detergent compositions are disclosed, for example, in PCT International Application WO 89/099813, published Oct. 19, 1989, by O. Kirk, assigned to Novo Industries A/S. The present invention encompasses peroxidase-free automatic dishwashing composition embodiments.

A wide range of enzyme materials and means for their incorporation into synthetic detergent compositions are also disclosed, in U.S. Pat. No. 3,553,139, issued Jan. 5, 1971 to McCarty et al. Enzymes are further disclosed in U.S. Pat. No. 4,101,457, Place et al, issued Jul. 18, 1978, and in U.S. Pat. No. 4,507,219, Hughes, issued Mar. 26, 1985. Enzymes for use in detergents can be stabilized by various techniques. Enzyme stabilization techniques are disclosed and exemplified in U.S. Pat. No. 3,600,319, issued Aug. 17, 1971 to Gedge, et al, and European Patent Application Publication No. 0 199 405, Application No. 86200586.5, published Oct. 29, 1986, Venegas. Enzyme stabilization systems are also described, for example, in U.S. Pat. No. 3,519,570.

pH and Buffering Variation

The detergent tablet compositions herein can be buffered, i.e., they are relatively resistant to pH drop in the presence of acidic soils. However, other compositions herein may have exceptionally low buffering capacity, or may be substantially unbuffered. Techniques for controlling or varying pH at recommended usage levels more generally include the use of not only buffers, but also additional alkalis, acids, pH-jump systems, dual compartment containers, etc., and are well known to those skilled in the art.

The preferred compositions herein comprise a pH-adjusting component selected from water-soluble alkaline inorganic salts and water-soluble organic or inorganic builders. The pH-adjusting components are selected so that when the composition is dissolved in water at a concentration of 1,000–10,000 ppm, the pH remains in the range of above about 8, preferably from about 9.5 to about 11. The preferred nonphosphate pH-adjusting component of the invention is selected from the group consisting of:

(i) sodium carbonate or sesquicarbonate;

(ii) sodium silicate, preferably hydrous sodium silicate having $SiO_2$:$Na_2O$ ratio of from about 1:1 to about 2:1, and mixtures thereof with limited quantities of sodium metasilicate;

(iii) sodium citrate;

(iv) citric acid;

(v) sodium bicarbonate;

(vi) sodium borate, preferably borax;

(vii) sodium hydroxide; and (viii) mixtures of(i)–(vii).

Preferred embodiments contain low levels of silicate (i.e. from about 3% to about 10% $SiO_2$).

The amount of the pH adjusting component in the instant composition is preferably from about 1% to about 50%, by weight of the composition. In a preferred embodiment, the pH-adjusting component is present in the composition in an amount from about 5% to about 40%, preferably from about 10% to about 30%, by weight.

Water-Soluble Silicates

The present compositions may further comprise water-soluble silicates. Water-soluble silicates herein are any silicates which are soluble to the extent that they do not adversely affect spotting/filming characteristics of the ADD composition.

Examples of silicates are sodium metasilicate and, more generally, the alkali metal silicates, particularly those having a $SiO_2$:$Na_2O$ ratio in the range 1.6:1 to 3.2:1, preferably having a $SiO_2$:$Na_2O$ ratio of about 1.0 to about 3.0; and layered silicates, such as the layered sodium silicates described in U.S. Pat. No. 4,664,839, issued May 12, 1987 to H. P. Rieck. NaSKS-6® is a crystalline layered silicate marketed by Hoechst (commonly abbreviated herein as "SKS-6"). Unlike zeolite builders, Na SKS-6 and other water-soluble silicates useful herein do not contain aluminum. NaSKS-6 is the $\delta$-$Na_2SiO_5$ form of layered silicate and can be prepared by methods such as those described in German DE-A-3,417,649 and DE-A-3,742,043. SKS-6 is a preferred layered silicate for use herein, but other such layered silicates, such as those having the general formula $NaMSi_xO^{2x+1}$. $yH_2O$ wherein M is sodium or hydrogen, x is a number from 1.9 to 4, preferably 2, and y is a number from 0 to 20, preferably 0 can be used. Various other layered silicates from Hoechst include NaSKS-5, NaSKS-7 and NaSKS-11, as the $\alpha$-, $\beta$- and $\gamma$-forms. Other silicates may also be useful, such as for example magnesium silicate, which can serve as a crispening agent in granular formulations, as a stabilizing agent for oxygen bleaches, and as a component of suds control systems.

Silicates particularly useful in automatic dishwashing (ADD) applications include granular hydrous 2-ratio silicates such as BRITESIL® H20 from PQ Corp., and the commonly sourced BRITESIL® H24 though liquid grades of various silicates can be used when the ADD composition has liquid form. Within safe limits, sodium metasilicate or sodium hydroxide alone or in combination with other silicates may be used in an ADD context to boost wash pH to a desired level.

Chelating Agents

The compositions herein may also optionally contain one or more transition-metal selective sequestrants, "chelants" or "chelating agents", e.g., iron and/or copper and/or manganese chelating agents. Chelating agents suitable for use herein can be selected from the group consisting of aminocarboxylates, phosphonates (especially the aminophosphonates), polyfunctionally-substituted aromatic chelating agents, and mixtures thereof. Without intending to be bound by theory, it is believed that the benefit of these materials is due in part to their exceptional ability to control iron, copper and manganese in washing solutions which are known to decompose hydrogen peroxide and/or bleach activators; other benefits include inorganic film prevention or scale inhibition. Commercial chelating agents for use herein include the DEQUEST® series, and chelants from Monsanto, DuPont, and Nalco, Inc.

Aminocarboxylates useful as optional chelating agents are further illustrated by ethylenediaminetetracetates, N-hydroxyethylethylenediaminetriacetates, nitrilotriacetates, ethylenediamine tetraproprionates, triethylenetetraaminehexacetates, diethylenetriaminepentaacetates, and ethanoldiglycines, alkali metal, ammonium, and substituted ammonium salts thereof. In general, chelant mixtures may be used for a combination of functions, such as multiple transition-metal control, long-term product stabilization, and/or control of precipitated transition metal oxides and/or hydroxides.

Polyfimctionally-substituted aromatic chelating agents are also useful in the compositions herein. See U.S. Pat. No. 3,812,044, issued May 21, 1974, to Connor et al. Preferred compounds of this type in acid form are dihydroxydisulfobenzenes such as 1,2-dihydroxy-3,5-disulfobenzene.

A highly preferred biodegradable chelator for use herein is ethylenediamine disuccinate ("EDDS"), especially (but not limited to) the [S,S] isomer as described in U.S. Pat. No. 4,704,233, Nov. 3, 1987, to Hartman and Perkins. The trisodium salt is preferred though other forms, such as magnesium salts, may also be useful.

Aminophosphonates are also suitable for use as chelating agents in the compositions of the invention when at least low levels of total phosphorus are acceptable in detergent compositions, and include the ethylenediaminetetrakis (methylenephosphonates) and the diethylenetriaminepentakis (methylene phosphonates). Preferably, these aminophosphonates do not contain alkyl or alkenyl groups with more than about 6 carbon atoms.

If utilized, chelating agents or transition-metal-selective sequestrants will preferably comprise from about 0.001% to about 10%, more preferably from about 0.05% to about 1% by weight of the compositions herein.

Crystal growth Inhibitor Component

The detergent tablets may preferably contain a crystal growth inhibitor component, preferably an organodiphosphonic acid component, incorporated more preferably at a level of from 0.01% to 5%, even more preferably from 0.1% to 2% by weight of the compositions.

By organo diphosphonic acid it is meant herein an organo diphosphonic acid which does not contain nitrogen as part of its chemical structure. This definition therefore excludes the organo aminophosphonates, which however may be included in compositions of the invention as heavy metal ion sequestrant components.

The organo diphosphonic acid is preferably a $C_1$–$C_4$ diphosphonic acid, more preferably a $C_2$ diphosphonic acid, such as ethylene diphosphonic acid, or most preferably ethane 1-hydroxy-1,1-diphosphonic acid (HEDP) and may be present in partially or fully ionized form, particularly as a salt or complex.

Dispersant Polymer

Preferred compositions herein may additionally contain a dispersant polymer. When present, a dispersant polymer in the instant compositions is typically at levels in the range from 0 to about 25%, preferably from about 0.5% to about 20%, more preferably from about 1% to about 8% by weight of the composition. Dispersant polymers are useful for improved filming performance of the present compositions, especially in higher pH embodiments, such as those in which wash pH exceeds about 9.5. Particularly preferred are polymers which inhibit the deposition of calcium carbonate or magnesium silicate on dishware.

Dispersant polymers suitable for use herein are further illustrated by the film-forming polymers described in U.S. Pat. No. 4,379,080 (Murphy), issued Apr. 5, 1983.

Suitable polymers are preferably at least partially neutralized or alkali metal, ammonium or substituted ammonium (e.g., mono-, di- or triethanolammonium) salts of polycarboxylic acids. The alkali metal, especially sodium salts are most preferred. While the molecular weight of the polymer can vary over a wide range, it preferably is from about 1,000 to about 500,000, more preferably is from about 1,000 to about 250,000, and most preferably, especially if the composition is for use in North American automatic dishwashing appliances, is from about 1,000 to about 5,000.

Other suitable dispersant polymers include those disclosed in U.S. Pat. No. 3,308,067 issued Mar. 7, 1967, to Diehl. Unsaturated monomeric acids that can be polymerized to form suitable dispersant polymers include acrylic acid, maleic acid (or maleic anhydride), fumaric acid, itaconic acid, aconitic acid, mesaconic acid, citraconic acid and methylenemalonic acid. The presence of monomeric segments containing no carboxylate radicals such as methyl vinyl ether, styrene, ethylene, etc. is suitable provided that such segments do not constitute more than about 50% by weight of the dispersant polymer.

Copolymers of acrylamide and acrylate having a molecular weight of from about 3,000 to about 100,000, preferably from about 4,000 to about 20,000, and an acrylamide content of less than about 50%, preferably less than about 20%, by weight of the dispersant polymer can also be used. Most preferably, such dispersant polymer has a molecular weight of from about 4,000 to about 20,000 and an acrylamide content of from about 0% to about 15%, by weight of the polymer.

Particularly preferred dispersant polymers are low molecular weight modified polyacrylate copolymers. Such copolymers contain as monomer units: a) from about 90% to about 10%, preferably from about 80% to about 20% by weight acrylic acid or its salts and b) from about 10% to about 90%, preferably from about 20% to about 80% by weight of a substituted acrylic monomer or its salt and have the general formula: —[(C($R^2$)C($R^1$)(C(O)O$R^3$)] wherein the apparently unfilled valencies are in fact occupied by hydrogen and at least one of the substituents $R^1$, $R^2$, or $R^3$, preferably $R^1$ or $R^2$, is a 1 to 4 carbon alkyl or hydroxyalkyl group; $R^1$ or $R^2$ can be a hydrogen and $R^3$ can be a hydrogen or alkali metal salt. Most preferred is a substituted acrylic monomer wherein $R^1$ is methyl, $R^2$ is hydrogen, and $R^3$ is sodium.

Suitable low molecular weight polyacrylate dispersant polymer preferably has a molecular weight of less than about 15,000, preferably from about 500 to about 10,000, most preferably from about 1,000 to about 5,000. The most preferred polyacrylate copolymer for use herein has a molecular weight of about 3,500 and is the fully neutralized form of the polymer comprising about 70% by weight acrylic acid and about 30% by weight methacrylic acid.

Other suitable modified polyacrylate copolymers include the low molecular weight copolymers of unsaturated aliphatic carboxylic acids disclosed in U.S. Pat. Nos. 4,530,766, and 5,084,535.

Agglomerated forms of the present compositions may employ aqueous solutions of polymer dispersants as liquid binders for making the agglomerate (particularly when the composition consists of a mixture of sodium citrate and sodium carbonate). Especially preferred are polyacrylates with an average molecular weight of from about 1,000 to about 10,000, and acrylate/maleate or acrylate/fumarate copolymers with an average molecular weight of from about 2,000 to about 80,000 and a ratio of acrylate to maleate or fumarate segments of from about 30:1 to about 1:2. Examples of such copolymers based on a mixture of unsaturated mono- and dicarboxylate monomers are disclosed in European Patent Application No. 66,915, published Dec. 15, 1982.

Other dispersant polymers useful herein include the polyethylene glycols and polypropylene glycols having a molecular weight of from about 950 to about 30,000 which can be obtained from the Dow Chemical Company of Midland, Mich. Such compounds for example, having a melting point within the range of from about 30° C. to about 100° C., can be obtained at molecular weights of 1,450, 3,400, 4,500, 6,000, 7,400, 9,500, and 20,000. Such compounds are formed by the polymerization of ethylene glycol or propylene glycol with the requisite number of moles of ethylene or propylene oxide to provide the desired molecular weight and melting point of the respective polyethylene glycol and polypropylene glycol. The polyethylene, polypropylene and mixed glycols are referred to using the formula:

$$HO(CH_2CH_2O)_m(CH_2CH(CH_3)O)_n(CH(CH_3)CH_2O)_oOH$$

wherein m, n, and o are integers satisfying the molecular weight and temperature requirements given above.

Yet other dispersant polymers useful herein include the cellulose sulfate esters such as cellulose acetate sulfate, cellulose sulfate, hydroxyethyl cellulose sulfate, methylcellulose sulfate, and hydroxypropylcellulose sulfate. Sodium cellulose sulfate is the most preferred polymer of this group. Also suitable are the cellulosic derivatives, such as cellulose acetate, cellulose, hydroxyethyl cellulose, methylcellulose, hydroxypropylcellulose and carboxy methly cellulose. These dispersant polymers also have the added advantage that they also reduce spotting and filming on hydrophobic surfaces such as plastic.

Other suitable dispersant polymers are the carboxylated polysaccharides, particularly starches, celluloses and alginates, described in U.S. Pat. No. 3,723,322, Diehl, issued Mar. 27, 1973; the dextrin esters of polycarboxylic acids disclosed in U.S. Pat. No. 3,929,107, Thompson, issued Nov. 11, 1975; the hydroxyalkyl starch ethers, starch esters, oxidized starches, dextrins and starch hydrolysates described in U.S. Pat No. 3,803,285, Jensen, issued Apr. 9, 1974; the carboxylated starches described in U.S. Pat. No. 3,629,121, Eldib, issued Dec. 21, 1971; and the dextrin starches described in U.S. Pat. No. 4,141,841, McDonald, issued Feb. 27, 1979. Preferred cellulose-derived dispersant polymers are the carboxymethyl celluloses.

Yet another group of acceptable dispersants are the naturally occurring organic dispersant polymers, such as polyaspartate.

Polymeric Soil Release Agent

Known polymeric soil release agents, hereinafter "SRA" or "SRA's", can optionally be employed in the present tablet compositions. If utilized, SRA's will generally comprise from 0.01% to 10.0%, typically from 0.1% to 5%, preferably from 0.2% to 3.0% by weight, of the composition.

Preferred SRA's typically have hydrophilic segments to hydrophilize the surface of hydrophobic fibers such as polyester and nylon, and hydrophobic segments to deposit upon hydrophobic fibers and remain adhered thereto through completion of washing and rinsing cycles thereby serving as an anchor for the hydrophilic segments. This can enable stains occurring subsequent to treatment with SRA to be more easily cleaned in later washing procedures. Alternatively, in an automatic dishwashing compositions, these hydrophobically modified polymers act to prevent redeposition on to hydrophobic surfaces, such as plastic, and provide the additional benefit of improved spotting and filming on hydrophobic surfaces. The most suitable polymers for these applications are the hydrophobically modified polyacrylates.

SRA's can include a variety of charged, e.g., anionic or even cationic (see U.S. Pat. No. 4,956,447), as well as noncharged monomer units and structures may be linear, branched or even star-shaped. They may include capping moieties which are especially effective in controlling molecular weight or altering the physical or surface-active properties. Structures and charge distributions may be tailored for application to different fiber or textile types and for varied detergent or detergent additive products.

Preferred SRAt's include oligomeric terephthalate esters, typically prepared by processes involving at least one transesterification/oligomerization, often with a metal catalyst such as a titanium(IV) alkoxide. Such esters may be made using additional monomers capable of being incorporated into the ester structure through one, two, three, four or more positions, without of course forming a densely crosslinked overall structure.

Suitable SRA's include: a sulfonated product of a substantially linear ester oligomer comprised of an oligomeric ester backbone of terephthaloyl and oxyalkyleneoxy repeat units and allyl-derived sulfonated terminal moieties covalently attached to the backbone, for example as described in U.S. Pat. No. 4,968,451, Nov. 6, 1990 to J. J. Scheibel and E. P. Gosselink: such ester oligomers can be prepared by (a) ethoxylating allyl alcohol, (b) reacting the product of (a) with dimethyl terephthalate ("DMT") and 1,2-propylene glycol ("PG") in a two-stage transesterification/oligomerization procedure and (c) reacting the product of (b) with sodium metabisulfite in water; the nonionic end-capped 1,2-propylene/polyoxyethylene terephthalate polyesters of U.S. Pat. No. 4,711,730, Dec. 8, 1987 to Gosselink et al, for example those produced by transesterification/oligomerization of poly(ethyleneglycol) methyl ether, DMT, PG and poly(ethyleneglycol) ("PEG"); the partly- and fully-anionic-end-capped oligomeric esters of U.S. Pat. No. 4,721,580, Jan. 26, 1988 to Gosselink, such as oligomers from ethylene glycol ("EG"), PG, DMT and Na-3,6-dioxa-8-hydroxyoctanesulfonate; the nonionic-capped block polyester oligomeric compounds of U.S. Pat. No. 4,702,857, Oct. 27, 1987 to Gosselink, for example produced from DMT, Me-capped PEG and EG and/or PG, or a combination of DMT, EG and/or PG, Me-capped PEG and Na-dimethyl-5-sulfoisophthalate; and the anionic, especially sulfoaroyl, end-capped terephthalate esters of U.S. Pat. No. 4,877,896, Oct. 31, 1989 to Maldonado, Gosselink et al, the latter being typical of SRA's useful in both laundry and fabric conditioning products, an example being an ester composition made from m-sulfobenzoic acid monosodium salt, PG and DMT optionally but preferably further comprising added PEG, e.g., PEG 3400.

SRA's also include simple copolymeric blocks of ethylene terephthalate or propylene terephthalate with polyethylene oxide or polypropylene oxide terephthalate, see U.S. Pat. No. 3,959,230 to Hays, May 25, 1976 and U.S. Pat. No. 3,893,929 to Basadur, Jul. 8, 1975; cellulosic derivatives such as the hydroxyether cellulosic polymers available as METHOCEL from Dow; and the $C_1$–$C_4$ alkylcelluloses and $C_4$ hydroxyalkyl celluloses; see U.S. Pat. No. 4,000,093, December 28, 1976 to Nicol, et al. Suitable SRA's characterised by poly(vinyl ester) hydrophobe segments include graft copolymers of poly(vinyl ester), e.g., $C_1$–$C_6$ vinyl esters, preferably poly(vinyl acetate), grafted onto polyalkylene oxide backbones. See European Patent Application 0 219 048, published Apr. 22, 1987 by Kud, et al. Commercially available examples include SOKALAN SRA's such as SOKALAN HP-22, available from BASF, Germany. Other SRA's are polyesters with repeat units containing 10–15% by weight of ethylene terephthalate together with 90–80% by weight of polyoxyethylene terephthalate, derived from a polyoxyethylene glycol of average molecular weight 300–5,000. Commercial examples include ZELCON 5126 from Dupont and MILEASE T from ICI.

Another preferred SRA is an oligomer having empirical formula $(CAP)_2(EG/PG)_5(T)_5(SIP)_1$ which comprises terephthaloyl (T), sulfoisophthaloyl (SIP), oxyethyleneoxy and oxy-1,2-propylene (EG/PG) units and which is preferably terminated with end-caps (CAP), preferably modified isethionates, as in an oligomer comprising one sulfoisophthaloyl unit, 5 terephthaloyl units, oxyethyleneoxy and oxy-1,2-propyleneoxy units in a defined ratio, preferably about 0.5:1 to about 10:1, and two end-cap units derived from sodium 2-(2-hydroxyethoxy)-ethanesulfonate. Said SRA preferably further comprises from 0.5% to 20%, by weight of the oligomer, of a crystallinity-reducing stabilizer, for example an anionic surfactant such as linear sodium dodecylbenzenesulfonate or a member selected from xylene-, cumene-, and toluene-sulfonates or mixtures thereof, these stabilizers or modifiers being introduced into the synthesis pot, all as taught in U.S. Pat. No. 5,415,807, Gosselink, Pan, Kellett and Hall, issued May 16, 1995. Suitable monomers for the above SRA include Na 2-(2-hydroxyethoxy)-ethanesulfonate, DMT, Na-dimethyl 5-sulfoisophthalate, EG and PG.

Yet another group of preferred SRA's are oligomeric esters comprising: (1) a backbone comprising (a) at least one unit selected from the group consisting of dihydroxysulfonates, polyhydroxy sulfonates, a unit which is at least trifunctional whereby ester linkages are formed resulting in a branched oligomer backbone, and combinations thereof; (b) at least one unit which is a terephthaloyl moiety; and (c) at least one unsulfonated unit which is a 1,2-oxyalkyleneoxy moiety; and (2) one or more capping units selected from nonionic capping units, anionic capping units such as alkoxylated, preferably ethoxylated, isethionates, alkoxylated propanesulfonates, alkoxylated propanedisulfonates, alkoxylated phenolsulfonates, sulfoaroyl derivatives and mixtures thereof. Preferred of such esters are those of empirical formula:

$$\{(CAP)x(EG/PG)y'(DEG)y''(PEG)y'''(T)z(SIP)z'(SEG)q(B)m\}$$

wherein CAP, EG/PG, PEG, T and SIP are as defined hereinabove, (DEG) represents di(oxyethylene)oxy units; (SEG) represents units derived from the sulfoethyl ether of glycerin and related moiety units; (B) represents branching units which are at least trifunctional whereby ester linkages are formed resulting in a branched oligomer backbone; x is from about 1 to about 12; y' is from about 0.5 to about 25; y" is from 0 to about 12; y" is from 0 to about 10; y'+y"+y'" totals from about 0.5 to about 25; z is from about 1.5 to about 25; z' is from 0 to about 12; z +z' totals from about 1.5 to about 25; q is from about 0.05 to about 12; m is from about 0.01 to about 10; and x, y', y", y'", z, z', q and m represent the average number of moles of the corresponding units per mole of said ester and said ester has a molecular weight ranging from about 500 to about 5,000.

Preferred SEG and CAP monomers for the above esters include Na-2-(2-,3-dihydroxypropoxy)ethanesulfonate ("SEG"), Na-2-{2-(2-hydroxyethoxy)ethoxy}ethanesulfonate ("SE3") and its homologs and mixtures thereof and the products of ethoxylating and sulfonating allyl alcohol. Preferred SRA esters in this class include the product of transesterifying and oligomerizing sodium 2-{2-(2-hydroxyethoxy)ethoxy}ethanesulfonate and/or sodium 2-[2-{2-(2-hydroxyethoxy)-ethoxy}ethoxylethanesulfonate, DMT, sodium 2-(2,3-dihydroxypropoxy)ethansulfonate, EG, and PG using an appropriate Ti(IV) catalyst and can be designated as (CAP)2(T)5(EG/PG)1.4(SEG)2.5(B)0.13 wherein CAP is ($Na+O_3S[CH_2CH_2O]3.5$)- and B is a unit from glycerin and the mole ratio EG/PG is about 1.7:1 as measured by conventional gas chromatography after complete hydrolysis.

Additional classes of SRA's include (I) nonionic terephthalates using diisocyanate coupling agents to link up polymeric ester structures, see U.S. Pat. No. 4,201,824, Violland et al. and U.S. Pat. No. 4,240,918 Lagasse et al; (II) SRA's with carboxylate terminal groups made by adding trimellitic anhydride to known SRA's to convert terminal hydroxyl groups to trimellitate esters. With a proper selection of catalyst, the trimellitic anhydride forms linkages to the terminals of the polymer through an ester of the isolated carboxylic acid of trimellitic anhydride rather than by opening of the anhydride linkage. Either nonionic or anionic SRA's may be used as starting materials as long as they have hydroxyl terminal groups which may be esterified. See U.S. Pat. No. 4,525,524 Tung et al.; (III) anionic terephthalate-based SRA's of the urethane-linked variety, see U.S. Pat. No. 4,201,824, Violland et al; (IV) poly(vinyl caprolactam) and related co-polymers with monomers such as vinyl pyrrolidone and/or dimethylaminoethyl methacrylate, including both nonionic and cationic polymers, see U.S. Pat. No. 4,579,681, Ruppert et al.; (V) graft copolymers, in addition to the SOKALAN types from BASF made, by grafting acrylic monomers on to sulfonated polyesters; these SRA's assertedly have soil release and anti-redeposition activity similar to known cellulose ethers: see EP 279,134 A, 1988, to Rhone-Poulenc Chemie; (VI) grafts of vinyl monomers such as acrylic acid and vinyl acetate on to proteins such as caseins, see EP 457,205 A to BASF (1991); (VII) polyester-polyamide SRA's prepared by condensing adipic acid, caprolactam, and polyethylene glycol, especially for treating polyamide fabrics, see Bevan et al, DE 2,335,044 to Unilever N. V., 1974. Other useful SRA's are described in U.S. Pat. Nos. 4,240,918, 4,787,989, 4,525,524 and 4,877,896.

Clay Soil Removal/Anti-redeposition Agents

The compositions of the present invention can also optionally contain water-soluble ethoxylated amines having clay soil removal and antiredeposition properties. Granular compositions which contain these compounds typically contain from about 0.01% to about 10.0% by weight of the water-soluble ethoxylates amines; liquid detergent compositions typically contain about 0.01% to about 5%.

The most preferred soil release and anti-redeposition agent is ethoxylated tetraethylenepentamine. Exemplary ethoxylated amines are further described in U.S. Pat. No. 4,597,898, VanderMeer, issued Jul. 1, 1986. Another group of preferred clay soil removal-antiredeposition agents are the cationic compounds disclosed in European Patent Application 111,965, Oh and Gosselink, published Jun. 27, 1984. Other clay soil removal/antiredeposition agents which can be used include the ethoxylated amine polymers disclosed in European Patent Application 111,984, Gosselink, published Jun. 27, 1984; the zwitterionic polymers disclosed in European Patent Application 112,592, Gosselink, published Jul. 4, 1984; and the amine oxides disclosed in U.S. Pat. No. 4,548,744, Connor, issued Oct. 22, 1985. Other clay soil removal and/or anti redeposition agents known in the art can also be utilized in the compositions herein. See U.S. Pat. No. 4,891,160, VanderMeer, issued Jan. 2, 1990 and WO 95/32272, published Nov. 30, 1995. Another type of preferred antiredeposition agent includes the carboxy methyl cellulose (CMC) materials. These materials are well known in the art.

Corrosion Inhibitor Compound

The detergent tablets of the present invention suitable for use in dishwashing methods may contain corrosion inhibitors preferably selected from organic silver coating agents, particularly paraffin, nitrogen-containing corrosion inhibitor compounds and Mn(II) compounds, particularly Mn(II) salts of organic ligands.

Organic silver coating agents are described in PCT Publication No. WO 94/16047 and copending European application No. EP-A-690122. Nitrogen-containing corrosion inhibitor compounds are disclosed in copending European Application no. EP-A-634,478. Mn(II) compounds for use in corrosion inhibition are described in copending European Application No. EP-A-672 749.

Organic silver coating agent, when present, may be incorporated at a level of preferably from about 0.05% to about 10%, more preferably from about 0.1% to about 5% by weight of the total composition.

The fluctional role of the silver coating agent is to form 'in use' a protective coating layer on any silverware components of the washload to which the compositions of the invention are being applied. The silver coating agent should. hence have a high affinity for attachment to solid silver surfaces, particularly when present in as a component of an aqueous washing and bleaching solution with which the solid silver surfaces are being treated.

Suitable organic silver coating agents herein include, but are not limited to, fatty esters of mono- or polyhydric alcohols having from about 1 to about 40 carbon atoms in the hydrocarbon chain.

The fatty acid portion of the fatty ester can be obtained from mono- or poly-carboxylic acids having from about 1 to about 40 carbon atoms in the hydrocarbon chain. Suitable examples of monocarboxylic fatty acids include behenic acid, stearic acid, oleic acid, palmitic acid, myristic acid, lauric acid, acetic acid, propionic acid, butyric acid, isobutyric acid, Valerie acid, lactic acid, glycolic acid and β,β'-dihydroxyisobutyric acid. Examples of suitable polycarboxylic acids include: n-butyl-malonic acid, isocitric acid, citric acid, maleic acid, malic acid and succinic acid.

The fatty alcohol radical in the fatty ester can be represented by mono- or polyhydric alcohols having from about 1 to about 40 carbon atoms in the hydrocarbon chain. Examples of suitable fatty alcohols include; behenyl, arachidyl, cocoyl, oleyl and lauryl alcohol, ethylene glycol, glycerol, ethanol, isopropanol, vinyl alcohol, diglycerol, xylitol, sucrose, erythritol, pentaerythritol, sorbitol or sorbitan.

Preferably, the fatty acid and/or fatty alcohol group of the fatty ester adjunct material have from about 1 to about 24 carbon atoms in the alkyl chain.

Preferred fatty esters herein are ethylene glycol, glycerol and sorbitan esters wherein the fatty acid portion of the ester normally comprises a species selected from behenic acid, stearic acid, oleic acid, palmitic acid or myristic acid.

The glycerol esters are also highly preferred. These are the mono-, di- or tri-esters of glycerol and the fatty acids as defined above.

Specific examples of fatty alcohol esters for use herein include: stearyl acetate, palmityl di-lactate, cocoyl isobutyrate, oleyl maleate, oleyl dimaleate, and tallowyl proprionate. Some fatty acid esters useful herein include: xylitol monopalmitate, pentaerythritol monostearate, sucrose monostearate, glycerol monostearate, ethylene glycol monostearate, sorbitan esters. Suitable sorbitan esters include sorbitan monostearate, sorbitan palmitate, sorbitan monolaurate, sorbitan monomyristate, sorbitan monobehenate, sorbitan mono-oleate, sorbitan dilaurate, sorbitan distearate, sorbitan dibehenate, sorbitan dioleate, and also mixed tallowalkyl sorbitan mono- and di-esters.

Glycerol monostearate, glycerol mono-oleate, glycerol monopahnitate, glycerol monobehenate, and glycerol distearate are preferred glycerol esters herein.

Suitable organic silver coating agents include triglycerides, mono or diglycerides, and wholly or partially hydrogenated derivatives thereof, and any mixtures thereof. Suitable sources of fatty acid esters include vegetable and fish oils and animal fats. Suitable vegetable oils include soy bean oil, cotton seed oil, castor oil, olive oil, peanut oil, safflower oil, sunflower oil, rapeseed oil, grapeseed oil, palm oil and corn oil.

Waxes, including microcrystalline waxes are suitable organic silver coating agents herein. Preferred waxes have a melting point in the range from about 35° C. to about 110° C. and comprise generally from about 12 to about 70 carbon atoms. Preferred are petroleum waxes of the paraffin and microcrystalline type which are composed of long-chain saturated hydrocarbon compounds.

Alginates and gelatin are suitable organic silver coating agents which can be used in the compositions herein.

Dialkyl amine oxides such as about $C_{12}$ to about $C_{20}$ methylamine oxide, and dialkyl quaternary ammonium compounds and salts, such as the about $C_{12}$ to about $C_{20}$ methylammonium halides are also suitable.

Other suitable organic silver coating agents include certain polymeric materials. Polyvinylpyrrolidones with an average molecular weight of from about 12,000 to about 700,000, polyethylene glycols (PEG) with an average molecular weight of from about 600 to about 10,000, polyamine N-oxide polymers, copolymers of N-vinylpyrrolidone and N-vinylimidazole, and cellulose derivatives such as methylcellulose, carboxymethylcellulose and hydroxyethylcellulose are examples of such polymeric materials.

Certain perfume materials, particularly those demonstrating a high substantivity for metallic surfaces, are also useful as the organic silver coating agents herein.

Polymeric soil release agents can also be used as an organic silver coating agent.

A preferred organic silver coating agent is a paraffin oil, typically a predominantly branched aliphatic hydrocarbon having a number of carbon atoms in the range of from about 20 to about 50; preferred paraffin oil selected from predominantly branched $C_{25-45}$ species with a ratio of cyclic to noncyclic hydrocarbons of from about 1:10 to about 2:1, preferably from about 1:5 to about 1:1. A paraffin oil meeting these characteristics, having a ratio of cyclic to noncyclic hydrocarbons of about 32:68, is sold by Wintershall, Salzbergen, Germany, under the trade name WINOG 70.

Suitable nitrogen-containing corrosion inhibitor compounds include imidazole and derivatives thereof such as benzimidazole, 2-heptadecyl imidazole and those imidazole derivatives described in Czech Patent No. 139,279 and British Patent GB-A-1,137,741, which also discloses a method for making imidazole compounds.

Also suitable as nitrogen-containing corrosion inhibitor compounds are pyrazole compounds and their derivatives, particularly those where the pyrazole is substituted in any of the 1, 3, 4 or 5 positions by substituents $R_1$, $R_3$, $R_4$ and $R_5$ where $R_1$ is any of H, $CH_2OH$, $CONH_3$, or $COCH_3$, $R_3$ and $R_5$ are any of $C_1$–$C_{20}$ alkyl or hydroxyl, and $R_4$ is any of H, $NH_2$ or $NO_2$.

Other suitable nitrogen-containing corrosion inhibitor compounds include benzotriazole, 2-mercaptobenzothiazole, 1-phenyl-5-mercapto-1,2,3,4-tetrazole, thionalide, morpholine, melamine, distearylamine, stearoyl stearamide, cyanuric acid, aminotriazole, aminotetrazole and indazole.

Nitrogen-containing compounds such as amines, especially distearylamine and ammonium compounds such as ammonium chloride, ammonium bromide, ammonium sulphate or diamonium hydrogen citrate are also suitable.

The detergent tablets may contain an Mn(II) corrosion inhibitor compound. The Mn(II) compound is preferably incorporated at a level of from about 0.005% to about 5% by weight, more preferably from about 0.01% to about 1%, most preferably from about 0.02% to about 0.4% by weight of the compositions. Preferably, the Mn(II) compound is incorporated at a level to provide from about 1.0. ppm to about 250 ppm, more preferably from about 0.5 ppm to about 50 ppm, even more preferably from about 1 ppm to about 20 ppm by weight of Mn(II) ions in any bleaching solution.

The Mn (II) compound may be an inorganic salt in anhydrous, or any hydrated forms. Suitable salts include manganese sulphate, manganese carbonate, manganese phosphate, manganese nitrate, manganese acetate and manganese chloride. The Mn(II) compound may be a salt or complex of an organic fatty acid such as manganese acetate or manganese stearate.

The Mn(II) compound may be a salt or complex of an organic ligand. In one preferred aspect the organic ligand is a heavy metal ion sequestrant. In another preferred aspect the organic ligand is a crystal growth inhibitor.

Other suitable additional corrosion inhibitor compounds include, mercaptans and diols, especially mercaptans with about 4 to about 20 carbon atoms including lauryl mercaptan, thiophenol, thionapthol, thionalide and thioanthranol. Also suitable are saturated or unsaturated $C_{10}$–$C_{20}$ fatty acids, or their salts, especially aluminium tristearate. The $C_{12}$–$C_{20}$ hydroxy fatty acids, or their salts, are also suitable. Phosphonated octa-decane and other anti-oxidants such as betahydroxytoluene (BHT) are also suitable.

Copolymers of butadiene and maleic acid, particularly those supplied under the trade reference no. 07787 by Polysciences Inc. have been found to be of particular utility as corrosion inhibitor compounds.

Another preferred detergent active component for use in the present invention is a hydrocarbon oil, typically a predominantly long chain, aliphatic hydrocarbons having a number of carbon atoms in the range of from about 20 to about 50; preferred hydrocarbons are saturated and/or branched; preferred hydrocarbon oil selected from predominantly branched $C_{25-45}$ species with a ratio of cyclic to noncyclic hydrocarbons of from about 1:10 to about 2:1, preferably from about 1:5 to about 1:1. A preferred hydrocarbon oil is paraffin. A paraffin oil meeting the characteristics as outlined above, having a ratio of cyclic to noncyclic hydrocarbons of about 32:68, is sold by Wintershall, Salzbergen, Germany, under the trade name WINOG 70.

The detergent tablets of the present invention suitable for use in dishwashing methods may contain a water-soluble bismuth compound, preferably present at a level of from about 0.005% to about 20%, more preferably from about 0.01% to about 5%, even more preferably from about 0.1% to about 1% by weight of the compositions.

The water-soluble bismuth compound may be essentially any salt or complex of bismuth with essentially any inorganic or organic counter anion. Preferred inorganic bismuth salts are selected from the bismuth trihalides, bismuth nitrate and bismuth phosphate. Bismuth acetate and citrate are preferred salts with an organic counter anion.

Colorant

The term 'colorant', as used herein, means any substance that absorbs specific wavelengths of light from the visible light spectrum. Such colorants when added to a detergent composition have the effect of changing the visible color and thus the appearance of the detergent composition. Colorants may be for example either dyes or pigments. Preferably the colorants are stable in composition in which they are to be incorporated. Thus in a composition of high pH the colorant is preferably alkali stable and in a composition of low pH the colorant is preferably acid stable.

The core, first encapsulating layer and/or second encapsulating layer may contain a colorant, a mixture of colorants, colored particles or mixture of colored particles such that the compressed portion and the core, first encapsulating layer and/or second encapsulating layer have different visual appearances. Preferably one of the core, first encapsulating layer and/or second encapsulating layer contain a colorant. The core, first encapsulating layer and/or second encapsulating layer may also be of one color and contain particles or speckles, of another color. For example the core could be white with blue speckles, while the first encapsulating layer is blue.

Examples of suitable dyes include reactive dyes, direct dyes, azo dyes. Preferred dyes include phthalocyanine dyes, anthraquinone dye, quinoline dyes, monoazo, disazo and polyazo. More preferred dyes include anthraquinone, quinoline and monoazo dyes. Preferred dyes include SANDOLAN E-HRL 180% (tradename), SANDOLAN MILLING BLUE (tradename), TURQUOISE ACID BLUE (tradename) and SANDOLAN BRILLIANT GREEN (tradename) all available from Clariant UK, HEXACOL QUINOLINE YELLOW (tradename) and HEXACOL BRILLIANT BLUE (tradename) both available from Pointings, LUK, ULTRA MARINE BLUE (tradename) available from Holliday or LEVAFIX TURQUISE BLUE EBA (tradename) available from Bayer, USA.

Furthermore, it is preferred that the colorant does not cause visible staining to plastic, such as an automatic dishwasher or plastic tableware, after a plurality of cycles, more preferably between 1 and 50 cycles.

The colorant may be incorporated into the core, first encapsulating layer and/or second encapsulating layer by any suitable method. Suitable methods include mixing all or selected detergent active components with a colorant in a drum or spraying all or selected detergent active components with the colorant in a rotating drum. Alternatively, the colorants color may be improved by predisolving the colorant in a compatible solvent prior to addition of the colorant to the composition.

Colorant when present as a component of the compressed portion is present at a level of from about 0.001% to about 1.5%, preferably from about 0.01% to about 1.0%, most preferably from about 0.1% to about 0.3%. When present as a component of a coating layer, colorant is present at a level of from about 0.01% to about 0.5%, more preferably from about 0.02% to about 0. 1%, most preferably from about 0.03% to about 0.06%.

Suds Suppressing System

The detergent tablets of the present invention, when formulated for use in machine washing compositions, preferably comprise a suds suppressing system present at a level of from about 0.01% to about 15%, preferably from about 0.05% to about 10%, most preferably from about 0.1% to about 5% by weight of the composition.

Suitable suds suppressing systems for use herein may comprise essentially any known antifoam compound, including, for example silicone antifoam compounds, 2-alkyl and alkanol antifoam compounds. Preferred suds suppressing systems and antifoam compounds are disclosed in PCT Application No. WO 93/08876 and EP-A-705 324.

The compositions of the invention can optionally contain an alkyl phosphate ester suds suppressor, a silicone suds suppressor, or combinations thereof.

Silicone suds suppressor technology and other defoaming agents useful herein are extensively documented in "Defoaming, Theory and Industrial Applications", Ed., P.R. Garrett, Marcel Dekker, N.Y., 1973, ISBN 0-8247-8770-6, incorporated herein by reference. See especially the chapters entitled "Foam control in Detergent Products" (Ferch et al) and "Surfactant Antifoams" (Blease et al). See also U.S. Pat. Nos. 3,933,672 and 4,136,045. Highly preferred silicone suds suppressors are the compounded types known for use in laundry detergents such as heavy-duty granules, although types hitherto used only in heavy-duty liquid detergents may also be incorporated in the instant compositions. For example, polydimethylsiloxanes having trimethylsilyl or alternate endblocking units may be used as the silicone. These may be compounded with silica and/or with surface-active nonsilicon components, as illustrated by a suds suppressor comprising 12% silicone/silica, 18% stearyl alcohol and 70% starch in granular form. A suitable commercial source of the silicone active compounds is Dow Corning Corp.

If it is desired to use a phosphate ester, suitable compounds are disclosed in U.S. Pat. No. 3,314,891, issued Apr. 18, 1967, to Schmolka et al, incorporated herein by reference. Preferred alkyl phosphate esters contain from 16–20 carbon atoms. Highly preferred alkyl phosphate esters are monostearyl acid phosphate or monooleyl acid phosphate, or salts thereof, particularly alkali metal salts, or mixtures thereof.

It has been found preferable to avoid the use of simple calcium-precipitating soaps as antifoams in the present compositions as they tend to deposit on the dishware. Indeed, phosphate esters are not entirely free of such problems and the formulator will generally choose to minimize the content of potentially depositing antifoams in the instant compositions.

Enzyme Stabilizing System

Preferred enzyme-containing compositions herein may comprise from about 0.001% to about 10%, preferably from about 0.005% to about 8%, most preferably from about 0.01% to about 6%, by weight of an enzyme stabilizing system. The enzyme stabilizing system can be any stabilizing system which is compatible with the detersive enzyme. Such stabilizing systems can comprise calcium ion, boric acid, propylene glycol, short chain carboxylic acid, boronic acid and mixtures thereof. Such stabilizing systems can also comprise reversible enzyme inhibitors, such as reversible protease inhibitors. For other suitable enzyme stabilizer and systems see Severson, U.S. Pat. No. 4,537,706.

Lime Soap Dispersant Compound

The compositions of detergent active components may contain a lime soap dispersant compound, preferably present at a level of from about 0. 1% to about 40% by weight, more preferably about 1% to about 20% by weight, most preferably from about 2% to about 10% by weight of the compositions.

A lime soap dispersant is a material that prevents the precipitation of alkali metal, ammonium or amine salts of fatty acids by calcium or magnesium ions. Preferred lime soap dispersant compounds are disclosed in PCT Application No. WO 93/08877.

Polymeric Dye Transfer Inhibiting Agents

The detergent tablets herein may also comprise from about 0.01% to about 10%, preferably from about 0.05% to about 0.5% by weight of polymeric dye transfer inhibiting agents.

The polymeric dye transfer inhibiting agents are preferably selected from polyamine N-oxide polymers, copolymers of N-vinylpyrrolidone and N-vinylimidazole, polyvinylpyrrolidonepolymers or combinations thereof.

Optical Brightener

The detergent tablets suitable for use in laundry washing methods as described herein, also optionally contain from about 0.005% to about 5% by weight of certain types of hydrophilic optical brighteners.

Hydrophilic optical brighteners useful herein include those having the structural formula:

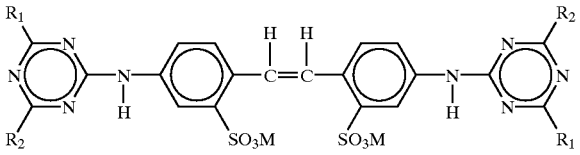

wherein $R_1$ is selected from anilino, N-2-bis-hydroxyethyl and NH-2-hydroxyethyl; $R_2$ is selected from N-2-bis-hydroxyethyl, N-2-hydroxyethyl-N-methylamino, morphilino, chloro and amino; and M is a salt-forming cation such as sodium or potassium.

When in the above formula, $R_1$ is anilino, $R_2$ is N-2-bis-hydroxyethyl and M is a cation such as sodium, the brightener is 4,4',-bis[(4-anilino-6-(N-2-bis-hydroxyethyl)-s-triazine-2-yl)amino]-2,2'-stilbenedisulfonic acid and disodium salt. This particular brightener species is commercially marketed under the tradename Tinopal-UNPA-GX by Ciba-Geigy Corporation. Tinopal-UNPA-GX is the preferred hydrophilic optical brightener useful in the detergent compositions herein.

When in the above formula, $R_1$ is anilino, $R_2$ is N-2-hydroxyethyl-N-2-methylamino and M is a cation such as sodium, the brightener is 4,4'-bis[(4-anilino-6-(N-2-hydroxyethyl-N-methylamino)-s-triazine-2-yl)amino]2,2'-stilbenedisulfonic acid disodium salt. This particular brightener species is commercially marketed under the tradename Tinopal 5BM-GX by Ciba-Geigy Corporation.

When in the above formula, $R_1$ is anilino, $R_2$ is morphilino and M is a cation such as sodium, the brightener is 4,4'-bis[(4-anilino-6-morphilino-s-triazine-2-yl)amino]2,2'-stilbenedisulfonic acid, sodium salt. This particular brightener species is commercially marketed under the tradename Tinopal AMS-GX by Ciba Geigy Corporation.

Clay Softening System

The detergent tablets suitable for use in laundry cleaning methods may contain a clay softening system comprising a clay mineral compound and optionally a clay flocculating agent.

The clay mineral compound is preferably a smectite clay compound. Smectite clays are disclosed in the U.S. Pat. Nos. 3,862,058, 3,948,790, 3,954,632 and 4,062,647. European Patents Nos. EP-A-299,575 and EP-A-313,146 in the name of the Procter and Gamble Company describe suitable organic polymeric clay flocculating agents.

Cationic Fabric Softening Agents

Cationic fabric softening agents can also be incorporated into compositions in accordance with the present invention which are suitable for use in methods of laundry washing. Suitable cationic fabric softening agents include the water insoluble tertiary amines or dilong chain amide materials as disclosed in GB-A-1 514 276 and EP-B-0 011 340.

Cationic fabric softening agents are typically incorporated at total levels of from about 0.5% to about 15% by weight, normally from about 1% to about 5% by weight.

Adjunct Materials

Detersive ingredients or adjuncts optionally included in the instant compositions can include one or more materials for assisting or enhancing cleaning performance, treatment of the substrate to be cleaned, processing aids, or designed to improve the aesthetics of the compositions. Adjuncts which can also be included in compositions of the present invention, at their conventional art-established levels for use (generally, adjunct materials comprise, in total, from about 30% to about 99.9%, preferably from about 70% to about 95%, by weight of the compositions), include other active ingredients such as color speckles, fillers, rinse aids (such as nonionic surfactants, solvents, polymeric dispersants etc,), germicides, hydrotropes, anti-oxidants, perfumes, solubilizing agents, carriers and processing aids.

Depending on whether a greater or lesser degree of compactness is required, filler materials can also be present in the instant compositions. These include sucrose, sucrose esters, sodium sulfate, potassium sulfate, etc., in amounts up to about 70%, preferably from 0% to about 40% of the composition. Preferred filler is sodium sulfate, especially in good grades having at most low levels of trace impurities.

Sodium sulfate used herein preferably has a purity sufficient to ensure it is non-reactive with bleach; it may also be treated with low levels of sequestrants, such as phosphonates or EDDS in magnesium-salt form. Note that preferences, in terms of purity sufficient to avoid decomposing bleach, applies also to pH-adjusting component ingredients, specifically including any silicates used herein.

The detergent tablets can also can contain processing aids which can assist in the production of the detergent tablets. For example, when the core, first encapsulating layer and/or second encapsulating layer is compressed it/they can contain a tableting aid, such as stearic acid, to increase the ease of removal of the compressed layer/s or core from the dyes of a tablet press.

Hydrotrope materials such as sodium benzene sulfonate, sodium toluene sulfonate, sodium cumene sulfonate, etc., can be present, e.g., for better dispersing surfactant.

Bleach-stable perfumes (stable as to odor); and bleach-stable dyes such as those disclosed in U.S. Pat. No. 4,714,562, Roselle et al, issued Dec. 22, 1987 can also be added to the present compositions in appropriate amounts.

Since the compositions herein can contain water-sensitive ingredients or ingredients which can co-react when brought together in an aqueous environment, it is desirable to keep the free moisture content at a minimum, e.g., 7% or less, preferably 5% or less of the compositions; and to provide packaging which is substantially impermeable to water and carbon dioxide. Coating measures have been described herein to illustrate a way to protect the ingredients from each other and from air and moisture. Plastic bottles, including refillable or recyclable types, as well as conventional barrier cartons or boxes are another helpful means of assuring maximum shelf-storage stability. As noted, when ingredients are not highly compatible, it may further be desirable to coat at least one such ingredient with a low-foaming nonionic surfactant for protection. There are numerous waxy materials which can readily be used to form suitable coated particles of any such otherwise incompatible components; however, the formulator prefers those materials which do not have a marked tendency to deposit or form films on dishes including those of plastic construction.

Form of Composition.

The detergent tablet can be of any conceivable form. The core, first encapsulating layer and/or second encapsulating layer can be the same or different in shapes. The size of the tablet is also similarly unrestricted. Preferably, the size is selected for ease of storage, ease of use and such that the tablet will fit into any dispensing devices used in cleaning, e.g. the detergent dispenser in an automatic dishwashing machine.

The core, first encapsulating layer and/or second encapsulating layer can be regular or irregular in shape. They can be any regular or irregular geometric forms such as, concave, convex, cubic, spheroidal, frustum of a cone (a section of a cone), rectangular prismic, cylindrical, disc, pyramodial, tetrahedral, dodecahedral, octahedral, conical, ellipsoidal, figure eight, or rhombohedral. See CRC Standard Mathematical Tables, 26th Ed, Dr. William H. Beyer Editor, pages 127, 128 and 276 to 278. They can even be lettering, symbols, caricatures, trademarks, images, such as corporate logos, cartoon characters, team logos or mascots. The list of possible shapes and combinations is endless.

When any part of the tablet has straight edges it is preferred that either the edges be chamfered or rounded. Additionally, when part of the tablet has comers, it is preferred that the comers be rounded.

Process

The multi-layer detergent tablet of the present invention can be made by any conventional process which will produce an encapsulated multi-layered detergent tablet. This includes, but is not limited to, moulds, tablet presses, coating or spraying. For example, a core could be formed in a mould, then surrounded by the first encapsulating layer which is formed by a tablet press around the core, and finally the second encapsulation layer is sprayed onto the first encapsulating layer.

One way the detergent tablets of the present invention is by separately preparing the core, first encapsulating layer and second encapsulating layer and then combining them to form the multi-layered detergent.

When the core, first encapsulating layer and/or second encapsulating layer are a compressed solid, they are prepared by obtaining the detergent active agent and optionally premixing with carrier components. Any pre-mixing will be carried out in a suitable mixer; for example a pan mixer, rotary drum, vertical blender or high shear mixer. Preferably dry particulate components are admixed in a mixer, as described above, and liquid components are applied to the dry particulate components, for example by spraying the liquid components directly onto the dry particulate components. The resulting composition is then formed into a compressed solid in a compression step using any known suitable equipment. Preferably the composition is formed into a compressed solid using a tablet press, wherein the tablet is prepared by compression of the composition between an upper and a lower punch. In a preferred embodiment of the present invention the composition is delivered into a punch cavity of a tablet press and compressed to form a compressed portion using a pressure of preferably greater than 6.3KN/cm 2, more preferably greater than 9KN/cm$^2$, most preferably greater than 14.4KN/cm$^2$.

As described in detail herein before, when the core, first encapsulating layer and/or second encapsulating layer are non-compressed the detergent active agent and any other ingredients in the non-compressed core, first encapsulating layer and/or second encapsulating layer are pre-mixed using any known suitable mixing equipment.

In addition when the core, first encapsulating layer and/or second encapsulating layer are non-compressed the non-compressed may optionally comprise a carrier with which the detergent active components are combined. The non-compressed core, first encapsulating layer and/or second encapsulating layer are non-compressed the may be prepared in solid or flowable form. The non-compressed, non-encapsulating portion may be delivered to a mould, which may contain a core or layer to be encapsulated, by manual delivery or using a nozzle feeder extruder or by any other suitable means. Preferably, the non-compressed material is delivered to the mould using accurate delivery equipment, for example a nozzle feeder, such as a loss in weight screw feeder available from Optima, Germany or an extruder.

Where the core, first encapsulating layer and/or second encapsulating layer is flowable non-compressed and is in particulate form the process comprises delivering a flowable non-compressed, non-encapsulating portion to the compressed portion in a delivery step and then coating at least a portion of the non-compressed, non-encapsulating portion with a coating layer such that the coating layer has the effect of substantially adhering the non-compressed portion to the compressed portion.

Where the second encapsulating layer is flowable non-compressed it is affixed to the first encapsulating layer by hardening, the process comprises a delivery step in which the second encapsulating layer is delivered to the first encapsulating layer such that the second encapsulating layer totally surrounds the first encapsulating layer and a subsequent conditioning step, wherein the non-compressed second encapsulating layer hardens. Such a conditioning step may comprise drying, cooling, binding, polymerization etc. of the non-compressed, non-encapsulating portion, during which the non-compressed, non-encapsulating portion becomes solid, semi-solid or highly viscous. Heat may be used in a drying step. Heat, or exposure to radiation may be used to effect polymerization in a polymerization step. This method can be also performed to surround the core when the first encapsulating layer is flowable and non-compressed.

The detergent tablets may be employed in any conventional domestic washing process wherein detergent tablets are commonly employed, including but not limited to automatic dishwashing and fabric laundering.

Machine dishwashing method Any suitable methods for machine washing or cleaning soiled tableware are envisaged.

A preferred machine dishwashing method comprises treating soiled articles elected from crockery, glassware, silverware, metallic items, cutlery and mixtures thereof, with an aqueous liquid having dissolved or dispensed therein an effective amount of a detergent tablet in accord with the invention. By an effective amount of the detergent tablet it is meant from 8 g to 60 g of product dissolved or dispersed in a wash solution of volume from 3 to 10 litres, as are typical product dosages and wash solution volumes commonly employed in conventional machine dishwashing methods. Preferably the detergent tablets are from 15 g to 40 g in weight, more preferably from 20 g to 35 g in weight.

Laundry Washing Method

Machine laundry methods herein typically comprise treating soiled laundry with an aqueous wash solution in a washing machine having dissolved or dispensed therein an effective amount of a machine laundry detergent tablet composition in accord with the invention. By an effective amount of the detergent tablet composition it is meant from 40 g to 300 g of product dissolved or dispersed in a wash solution of volume from 5 to 65 litres, as are typical product dosages and wash solution volumes commonly employed in conventional machine laundry methods.

In a preferred use aspect a dispensing device is employed in the washing method. The dispensing device is charged with the detergent product, and is used to introduce the product directly into the drum of the washing machine before the commencement of the wash cycle. Its volume capacity should be such as to be able to contain sufficient detergent product as would normally be used in the washing method.

Once the washing machine has been loaded with laundry the dispensing device containing the detergent product is placed inside the drum. At the commencement of the wash cycle of the washing machine water is introduced into the drum and the drum periodically rotates. The design of the dispensing device should be such that it permits containment of the dry detergent product but then allows release of this product during the wash cycle in response to its agitation as the drum rotates and also as a result of its contact with the wash water.

To allow for release of the detergent product during the wash the device may possess a number of openings through which the product may pass. Alternatively, the device may be made of a material which is permeable to liquid but impermeable to the solid product, which will allow release of dissolved product. Preferably, the detergent product will be rapidly released at the start of the wash cycle thereby providing transient localized high concentrations of product in the drum of the washing machine at this stage of the wash cycle.

Preferred dispensing devices are reusable and are designed in such a way that container integrity is maintained in both the dry state and during the wash cycle.

Alternatively, the dispensing device may be a flexible container, such as a bag or pouch. The bag may be of fibrous construction coated with a water impermeable protective material so as to retain the contents, such as is disclosed in European published Patent Application No. 0018678. Alternatively it may be formed of a water-insoluble synthetic polymeric material provided with an edge seal or closure designed to rupture in aqueous media as disclosed in European published Patent Application Nos. 0011500, 0011501, 0011502, and 0011968. A convenient form of water frangible closure comprises a water soluble adhesive disposed along and sealing one edge of a pouch formed of a water impermeable polymeric film such as polyethylene or polypropylene.

EXAMPLES

The following non limiting examples further illustrate the present invention. The exemplified compositions include both automatic dishwashing and laundry compositions.

Abbreviations used in Examples

In the detergent compositions, the abbreviated component identifications have the following meanings:

STPP: Sodium tripolyphosphate

Zeolite Zeolite A,

Citrate: Tri-sodium citrate dihydrate

Bicarbonate: Sodium hydrogen carbonate

Citric Acid: Anhydrous Citric acid

Carbonate: Anhydrous sodium carbonate

Silicate Amorphous Sodium Silicate ($SiO_2$:$Na_2O$ ratio=1.6–3.2)

Metasilicate Sodium metasilicate ($SiO_2$:$Na_2O$ ratio=1.0)

PB1: Anhydrous sodium perborate monohydrate

PB4: Sodium perborate tetrahydrate of nominal formula $NaBO_2.3H_2O.\ H_2O_2$

TAED: Tetraacetyl ethylene diamine

Plurafac $C_{13}$–$C_{15}$ mixed ethoxylated/propoxylated fatty alcohol with an average degree of ethoxylation of 3.8 and an average degree of propoxylation of 4.5, sold under the tradename Plurafac by BASF Tergitol: Nonionic surfactant available under the tradename Tergitol 15S9 from Union Carbide SLF18: Epoxy-capped poly(oxyalkylated) alcohol of Example III of WO 94/22800 wherein 1,2-epoxydodecane is substituted for 1,2-epoxydecane available under the tradename Polytergent SLF1 8D from OLIN.

HEDP: Ethane 1-hydroxy-1,1-diphosphonic acid

DETPMP: Diethyltriamine penta(methylene) phosphonate, marketed by monsanto under the tradenane Dequest 2060

PAAC Pentaamine acetate cobalt (III) salt

BzP: Benzoyl Peroxide

Paraffin: Paraffin oil sold under the tradename Winog 70 by Wintershall.

Protease: Proteolytic enzyme

Amylase: Amylolytic enzyme.

480N: Random copolymer of 7:3 acrylate/methacrylate, average molecular weight 3,500

Sulphate: Anhydrous sodium sulphate.

PEG 3000: Polyethylene Glycol molecular weight approximately 3000 available from Hoechst PEG 6000: Polyethylene Glycol molecular weight approximately 6000 available from Hoechst Sugar: Household sucrose Gelatine: Gelatine Type A, 65 bloom strength available from Sigma CMC Carboxymethylcellulose Dodecandioic Acid C12 dicarboxylic acid Adipic Acid C6 dicarboxylic acid Lauric Acid C12 monocarboxylic acid BTA: Benzotriazole PA30 Polyacrylic acid of average molecular weight approximately 4,500 pH: Measured as a 1% solution in distilled water at 20° C.

Example 1A

A detergent tablet according to the present invention may be prepared as follows. A detergent composition as in Example 2, formulation A is prepared and passed into a conventional rotary press. This forms the core of the tablet. A gel matrix formulation as disclosed in Example 2, formulation A is then prepared. The proper amount of non-aqueous solvent is provided to a mixer and shear is applied to the solvent at a moderate rate (2,500–5,000 rpm). The proper amount of gelling agent is gradually added to the solvent under shear conditions until the mixture is homogeneous. The shear rate of the mixture is gradually increased to high shear condition of around 10,000 rpm. The temperature of the mixture is increased to between 55° C. and 60° C. The shear is then stopped and the mixture is allowed to cool to temperatures between 35° C. and 45° C. Using a low shear mixer, the remaining ingredients are then added to the mixture as solids. The final mixture is then metered into a mould which contains the compressed solid core. The core is surrounded by the first encapsulating layer. The tablet is allowed to stand until the gel hardens or is no longer flowable. The second encapsulating layer is then sprayed on to the tablet, encapsulating the first encapsulation layer.

Example 1B

A detergent tablet according to the present invention may be prepared as follows. A gel matrix formulation as disclosed in Example 2, formulation A is prepared. The proper amount of non-aqueous solvent is provided to a mixer and shear is applied to the solvent at a moderate rate (2,500–5,000 rpm). The proper amount of gelling agent is gradually added to the solvent under shear conditions until the mixture is homogeneous. The shear rate of the mixture is gradually increased to high shear condition of around 10,000 rpm. The temperature of the mixture is increased to between 55° C. and 60° C. The shear is then stopped and the mixture is allowed to cool to temperatures between 35° C. and 45° C. Using a low shear mixer, the remaining ingredients are then added to the mixture as solids. The final mixture is then metered into a mould of the desired shape and allowed to stand until the gel hardens or is no longer flowable.

Example 2

| | A | B | C | D | E | F |
|---|---|---|---|---|---|---|
| Core | | | | | | |
| STPP | 15.00 | 42.00 | 37.00 | 35.00 | 40.00 | 25.00 |
| Citrate | | — | — | — | — | — |
| Carbonate | 5.4 | 11.00 | 12.00 | 16.00 | 11.00 | 15.50 |
| Metasilicate | | | | 20.00 | | 20.00 |
| Silicate | 30.00 | 12.00 | 11.00 | 10.00 | 3.50 | 10.00 |
| Protease[1] | — | — | — | 1.00 | — | — |
| Amylase[2] | — | — | 0.001 | 0.46 | 1.0 | 0.75 |
| PB1 | 1.5 | 7.00 | 6.10 | 9.00 | 10.00 | 6.50 |
| PB4 | 5.00 | — | — | — | — | — |
| Nonionic | 1.00 | 0.75 | 1.20 | 3.00 | 0.25 | 1.30 |
| PAAC | — | 0.008 | 0.016 | 0.006 | — | 0.004 |
| TAED | 4.00 | — | — | — | 0.65 | — |
| HEDP | 0.50 | — | — | — | — | 0.46 |
| DETPMP | 0.60 | — | — | — | — | — |
| Paraffin | 0.50 | 0.50 | 0.50 | 0.70 | 0.25 | — |
| BTA | 0.50 | 0.30 | 0.30 | 0.20 | 0.30 | — |
| PA30 | 2.00 | — | — | — | — | — |
| Crosslinked PA | — | 2.2 | — | — | — | — |
| Sulphate | 15.00 | 20.0 | 29.50 | 0.50 | 7.00 | — |
| Dipropyleneglycol butylether | — | — | — | — | — | 17.00 |
| Glycerol Triacetate | 17.00 | — | — | — | 24.00 | — |
| Thixatrol ST ® | — | — | — | — | 2.00 | — |
| Polyethylene glycol[3] | 2.00 | — | — | — | — | 1.50 |
| Misc./water to balance | q.s. | q.s. | q.s. | q.s. | q.s. | q.s. |
| Weight (g) | 20.0 g | 20.0 g | 20.0 g | 20.0 g | 22 g | 30.0 g |
| First encapsulating Layer | | | | | | |
| Tergitol | — | — | 21.5 | — | — | — |
| PEG 4000 | 89.40 | — | — | 90.00 | 45.00 | 20.00 |
| PEG 8000 | | 86.9 | — | — | — | — |
| BzP | — | 11.00 | — | — | 45.00 | — |
| Sugar | — | — | 53.4 | — | — | 65.00 |
| Water soluble silicate[4] | 10.60 | — | — | — | — | — |
| Carbonate | — | — | — | 10.0 | 10.0 | — |
| Gelatine | — | — | 15.01 | 30.00 | 5.00 | 5.00 |
| Starch | — | — | — | 10.00 | — | — |
| Water | — | — | 10.00 | 10.00 | 10.00 | 10.00 |
| Misc./balance | q.s. | q.s. | q.s. | q.s. | q.s. | q.s. |
| Weight (g) | 2.5 g | 5.0 g | 2.5 g | 2.5 g | 3 g | 3 g |

-continued

| | A | B | C | D | E | F |
|---|---|---|---|---|---|---|
| Second encapsulating layer | | | | | | |
| Dipropyleneglycol butylether | — | 45.00 | — | — | — | — |
| Glycerol Triacetate | 30.00 | — | 33.8 | — | 26.00 | 34.00 |
| Thixatrol ST ® | — | 33.00 | — | — | — | — |
| Polyethylene glycol[3] | 50.00 | — | 3.80 | — | 3.0 | 3.6 |
| Protease[1] | — | 5.5 | 10.7 | 9.5 | 10.00 | 10.00 |
| Amylase[2] | — | 5.5 | 10.7 | 9.5 | 10.00 | 10.00 |
| Sugar | — | — | — | 29.04 | — | — |
| Gelatine | — | — | — | 30.00 | — | — |
| Starch | — | — | — | 10.00 | — | — |
| Bicarbonate | — | — | 23.0 | — | 23.0 | 23.0 |
| Citrate | — | — | 18.0 | — | 18.0 | 18.0 |
| Endolase | — | — | — | — | 10.0 | — |
| Water | — | — | — | 10.00 | — | — |
| Misc./balance | q.s. | q.s. | q.s. | q.s. | q.s. | q.s. |
| Weight (g) | 2.5 g | 5.0 g | 2.5 g | 2.5 g | 3 g | 3 g |
| Total weight (g) of tablet | 22.5 g | 25 g | 22.5 g | 22.5 g | 25 g | 33 g |

[1]Protease enzyme can be either Savinase ® or as disclosed in U. S. 5,677,272.
[2]Amylase enzyme can be as disclosed in Novo Nordisk application PCT/DK96/00056 and is obtained from an alkalophilic Bacillus species having a N-terminal sequence of: His-His-Asn-Gly-Thr-Asn-Gly-Thr-Met-Met-Gln-Tyr-Phe-Glu-Trp-Tyr-Leu-Pro-Asn-Asp, or Termamyl ®.
[3]MW 4,000–8,000.
[4]SKS-6 water soluble silicate.

What is claimed is:

1. A multi-layered detergent tablet comprising:

a) a core having a first detergent active agent;

b) a first encapsulating layer surrounding said core, having a second detergent active agent;

c) a second encapsulating layer surrounding said first encapsulating layer; having a third detergent active agent and a disruption system; and d) from about 1% to about 50%, by weight of the composition, a pH-adjusting component selected from the group consisting of water-soluble alkaline inorganic salts, water-soluble organic, inorganic builders, and mixtures thereof, wherein the pH-adjusting components are selected so that when the composition is dissolved in water at a concentration of 1,000–10,000 ppm, the pH remains in the range of above about 8;

wherein disruption of said second encapsulating layer is such that at least 25% of said third detergent active agent is released prior to release of said second, detergent active agent; wherein said first encapsulating layer is in the form of a non-compressed solid; and wherein disruption of said second encapsulating laver occurs; in 0 an aqueous cleanig environment at a temperature of 25° C. or less and wherein release of said second detergent active agent occurs in an aqueous cleaning environment at a ten e of 30° C. or greater.

2. A multi-layered detergent tablet according to claim 1 wherein the disruption system comprises a salt of carbonate or bicarbonate and an organic acid.

3. A multi-layered detergent tablet according to claim 1 wherein said first detergent active agent is selected from the group consisting of surfactants, bleaching systems, chelants, bleach scavengers, suds suppressing system, enzymes, builders, polymeric dispersants, silver care agents, silicates, buffers, soil release agents, corrosion inhibitors, glass care and mixtures thereof.

4. A multi-layered detergent tablet according to claim 1 wherein said core further contains a disruption system.

5. A multi-layered detergent tablet according to claim 1 wherein said second detergent active agent is selected from the group consisting of surfactants, bleaching systems, chelants, bleach scavengers, suds suppessing system, enzymes, builders, polymeric dispersants, silver care agents, silicates, buffers, soil release agents, corrosion inhibitors, glass care and mixtures thereof.

6. A multi-layered detergent tablet according to claim 1 wherein said third detergent active agent is selected from the group consisting of surfactants, bleaching systems, chelants, suds suppessing system, enzymes, builders, polymeric dispersants, silver care agents, silicates, buffers, soil release agents, corrosion inhibitors, glass care and mixtures thereof.

7. A multi-layered detergent tablet according to claim 1 wherein said core is in the form of a compressed solid.

8. A multi-layered detergent tablet according to claim 1 wherein said third detergent active agent is an enzyme, said second detergent active is a bleaching system and said first detergent active is a nonionic surfactant and a polymeric dispersant.

9. A multi-layered detergent tablet according to claim 1 wherein said first layer contains a disruption system and is such that at least 25% of said second detergent active agent is released prior to release of said first detergent active agent.

10. A multi-layered detergent tablet according to claim 1 wherein said first active agent is a rinse aid.

11. A method of washing tableware in a domestic automatic dishwashing appliance, said method comprising treating the soiled tableware in an automatic dishwasher with said multi-layered detergent tablet according to claim 1.

12. A multi-layered detergent tablet comprising:

a) a core having a first detergent active agent;

b) a first encapsulating layer surrounding said core, having a second detergent active agent;

c) a second encapsulating layer surrounding said first encapsulating layer, having a third detergent active agent and a disruption system; and d) from about 1% to about 50%, by weight of the composition, a pH-adjusting component selected from the group consisting of water-soluble alkaline inorganic salts, water-soluble organic, inorganic builders, and mixtures thereof, wherein the pH-adjusting components are selected so that when the compositions dissolved in water at a concentration of 1,000–10,000 ppm, the pH remains in the range of above about 8;

wherein disruption of said second encapsulating layer is such that said third detergent active agent is released at least 2 minutes prior to release of said second detergent active agent; wherein said second encapsulating layer is in the form of a non-compressed solid; and wherein disruption of said second encapsulating layer occurs in an aqueous cleaning environment at a temperature of 25° C. or less and wherein release of said second detergent active agent occurs in an aqueous cleaning environment at a temperature of 3° C. or greater.

13. A multi-layered detergent tablet according to claim 12 wherein said second encapsulating layer is coated with a coating layer.

14. A multi-layered detergent tablet according to claim 12 wherein said third active agent is a low pH enzyme and said second active agent is a high pH enzyme.

15. A multi-layered detergent tablet comprising:

a) a core having a first detergent active agent;

b) a first encapsulating layer surrounding said core, having a second detergent active agent;

c) a second encapsulating layer surrounding said first encapsulating layer, having a third detergent active agent and a disruption system; and d) from about 1% to about 50%, by weight of the composition, a pH-adjusting component selected from the group consisting of water-soluble alkaline inorganic salts, water-soluble organic, inorganic and builders, and mixtures thereof, wherein the pH-adjusting components are selectedso that when the composition is dissolved in water at a concentration of 1,000–10,000 ppm, the pH remains in the range of above about 8;

wherein disruption of said second encapsulating layer occurs in an aqueous cleaning environment at a temperature of 25° C. or less and wherein release of said second detergent active agent occurs in an aqueous cleaning environment at a temperature of 30° C. or greater; and wherein said first encapsulating layer is in the form of a non-compressed solid.

* * * * *